US006779980B1

(12) United States Patent
Brittingham et al.

(10) Patent No.: US 6,779,980 B1
(45) Date of Patent: Aug. 24, 2004

(54) AIRFOIL SHAPE FOR A TURBINE BUCKET

(75) Inventors: Robert Alan Brittingham, Piedmont, SC (US); Edward Durell Benjamin, Greenville, SC (US); Jacob Charles Perry, II, Taylors, SC (US); Craig Allen Bielek, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 53 days.

(21) Appl. No.: 10/386,676

(22) Filed: Mar. 13, 2003

(51) Int. Cl.[7] ..... F01D 5/14

(52) U.S. Cl. ..... 416/243; 416/223 A; 416/DIG. 2; 416/DIG. 5

(58) Field of Search ..... 416/243, 223 A, 416/DIG. 2, DIG. 5

(56) References Cited

U.S. PATENT DOCUMENTS 5,980,209 A * 11/1999 Barry et al. ..... 416/223 A
6,461,110 B1 * 10/2002 By et al. ..... 416/223 A
6,474,948 B1 * 11/2002 Pirolla et al. ..... 416/243

* cited by examiner

*Primary Examiner*—Ninh H. Nguyen
(74) *Attorney, Agent, or Firm*—Nixon & Vanderhye

(57) ABSTRACT

First stage turbine buckets have airfoil profiles substantially in accordance with Cartesian coordinate values of X, Y and Z set forth Table I wherein X and Y values are in inches and the Z values are non-dimensional values from 0 to 1 convertible to Z distances in inches by multiplying the Z values by the height of the airfoil in inches. The X and Y values are distances which, when connected by smooth continuing arcs, define airfoil profile sections at each distance Z. The profile sections at each distance Z are joined smoothly to one another to form a complete airfoil shape. The X, Y and Z distances may be scalable as a function of the same constant or number to provide a scaled up or scaled down airfoil section for the bucket. The nominal airfoil given by the X, Y and Z distances lies within an envelop of ±0.040 inches in directions normal to the surface of the airfoil.

21 Claims, 3 Drawing Sheets

AIRFOIL SHAPE FOR A TURBINE BUCKET

BACKGROUND OF THE INVENTION

The present invention relates to an airfoil for a bucket of a stage of a gas turbine and particularly relates to a first stage turbine bucket airfoil profile.

Many system requirements must be met for each stage of the hot gas path section of a gas turbine in order to meet design goals including overall improved efficiency and airfoil loading. Particularly, the buckets of the first stage of the turbine section must meet the operating requirements for that particular stage and also be capable of efficient manufacture.

BRIEF DESCRIPTION OF THE INVENTION

In accordance with the preferred embodiment of the present invention there is provided a unique airfoil shape for a bucket of a gas turbine, preferably the first stage bucket, that enhances the performance of the gas turbine. The airfoil shape hereof improves the interaction between various stages of the turbine, affords improved aerodynamic efficiency and improved first stage airfoil aerodynamic and mechanical loading. The bucket airfoil profile is defined by a unique loci of points to achieve the necessary efficiency and loading requirements whereby improved turbine performance is obtained. These unique loci of points define the nominal airfoil profile and are identified by the X, Y and Z Cartesian coordinates of Table I which follows. The 3600 points for the coordinate values shown in Table I are relative to the turbine centerline and for a cold, i.e., room temperature bucket at various cross-sections of the bucket airfoil along its length. The positive X, Y and Z directions are axial toward the exhaust end of the turbine, tangential in the direction of engine rotation and radially outwardly toward the bucket tip, respectively. The X and Y coordinates are given in distance dimensions, e.g., units of inches, and are joined smoothly at each Z location to form a smooth continuous airfoil cross-section. The Z coordinates are given in non-dimensionalized form from 0 to 1. By multiplying the airfoil height dimension, e.g., in inches, by the non-dimensional Z value of Table I, the airfoil shape, i.e., the profile, of the bucket is obtained. Each defined airfoil section in the X, Y plane is joined smoothly with adjacent airfoil sections in the Z direction to form the complete airfoil shape.

It will be appreciated that as each bucket airfoil heats up in use, the profile will change as a result of mechanical loading and temperature. Thus, the cold or room temperature profile is given by the X, Y and Z coordinates for manufacturing purposes. Because a manufactured bucket airfoil profile may be different from the nominal airfoil profile given by the following table, a distance of plus or minus 0.040 inches from the nominal profile in a direction normal to any surface location along the nominal profile and which includes any coating process, defines a profile envelope for this bucket airfoil. The airfoil shape is robust to this variation without impairment of the mechanical and aerodynamic functions of the bucket.

It will also be appreciated that the airfoil can be scaled up or scaled down geometrically for introduction into similar turbine designs. Consequently, the X and Y coordinates in inches and the non-dimensional Z coordinates, when converted to inches, of the nominal airfoil profile given below may be a function of the same constant or number. That is, the X, Y and Z coordinate values in inches may be multiplied or divided by the same constant or number to provide a scaled up or scaled down version of the bucket airfoil profile while retaining the airfoil section shape.

In a preferred embodiment according to the present invention, there is provided a turbine bucket including a bucket airfoil having an airfoil shape, the airfoil having a nominal profile substantially in accordance with Cartesian coordinate values of X, Y and Z set forth in Table I wherein the Z values are non-dimensional values from 0 to 1 convertible to Z distances in inches by multiplying the Z values by a height of the airfoil in inches, and wherein X and Y are distances in inches which, when connected by smooth continuing arcs, define airfoil profile sections at each distance Z, the profile sections at the Z distances being joined smoothly with one another to form a complete airfoil shape.

In a further preferred embodiment according to the present invention, there is provided a turbine bucket including a bucket airfoil having an uncoated nominal airfoil profile substantially in accordance with Cartesian coordinate values of X, Y and Z set forth in Table I wherein the Z values are non-dimensional values from 0 to 1 convertible to Z distances in inches by multiplying the Z values by a height of the airfoil in inches, and wherein X and Y are distances in inches which, when connected by smooth continuing arcs, define airfoil profile sections at each Z distance, the profile sections at the Z distances being joined smoothly with one another to form a complete airfoil shape, the X, Y and Z distances being scalable as a function of the same constant or number to provide a scaled-up or scaled-down airfoil.

In a further preferred embodiment according to the present invention, there is provided a turbine comprising a turbine wheel having a plurality of buckets, each of the buckets including an airfoil having an airfoil shape, the airfoil having a nominal profile substantially in accordance with Cartesian coordinate values of X, Y and Z set forth in Table I wherein the Z values are non-dimensional values from 0 to 1 convertible to Z distances in inches by multiplying the Z values by a height of the airfoil in inches, and wherein X and Y are distances in inches which, when connected by smooth continuing arcs, define the airfoil profile sections at each distance Z, the profile sections at the Z distances being joined smoothly with one another to form a complete airfoil shape.

In a Preferred embodiment according to the present invention, there is provided a turbine comprising a turbine wheel having a plurality of buckets, each of the buckets including an airfoil having an uncoated nominal airfoil profile substantially in accordance with Cartesian coordinate values of X, Y and Z set forth in Table I wherein the Z values are non-dimensional values from 0 to 1 convertible to Z distances in inches by multiplying the Z values by a height of the airfoil in inches, and wherein X and Y are distances in inches which, when connected by smooth continuing arcs, define airfoil profile sections at each distance Z, the profile sections at the Z distances being joined smoothly with one another to form a complete airfoil shape, the X, Y and Z distances being scalable as a function of the same constant or number to provide a scaled-up or scaled-down bucket airfoil.

DETAILED DESCRIPTION OF THE INVENTION

Figure 1:
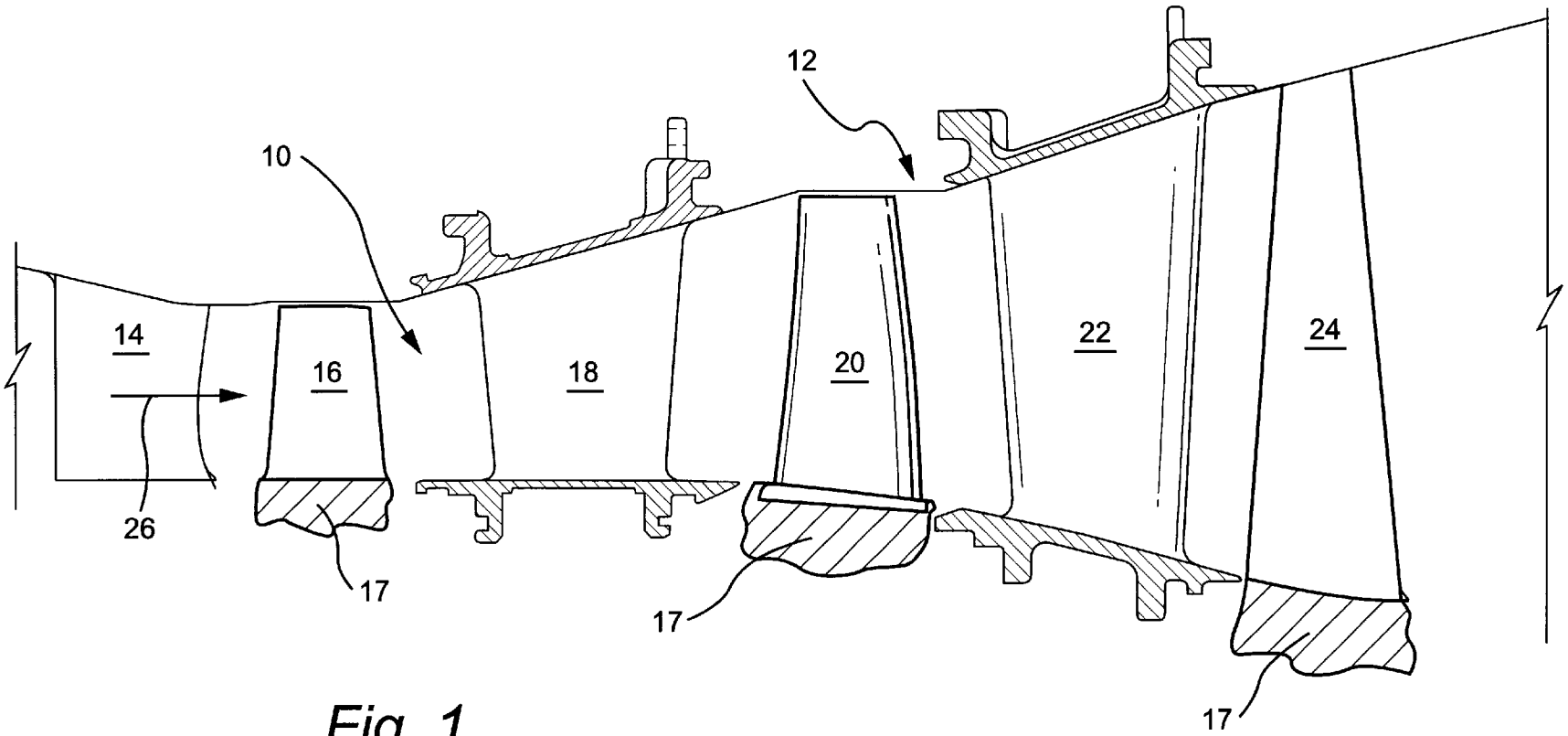
FIG. 1 is a schematic representation of a hot gas path through multiple stages of a gas turbine and illustrates a first stage bucket airfoil according to a preferred embodiment of the present invention.

Referring now to the drawings, particularly to FIG. 1, there is illustrated a hot gas path, generally designated 10, of a gas turbine 12 including a plurality of turbine stages. Three stages are illustrated. For example, the first stage comprises a plurality of circumferentially spaced nozzles 14 and buckets 16. The nozzles are circumferentially spaced one from the other and fixed about the axis of the rotor. The first stage buckets 16, of course, are mounted on the turbine rotor 17. A second stage of the turbine 12 is also illustrated, including a plurality of circumferentially spaced nozzles 18 and a plurality of circumferentially spaced buckets 20 mounted on the rotor 17. The third stage is also illustrated including a plurality of circumferentially spaced nozzles 22 and buckets 24 mounted on rotor 17. It will be appreciated that the nozzles and buckets lie in the hot gas path 10 of the turbine, the direction of flow of the hot gas through the hot gas path 10 being indicated by the arrow 26.

Figure 3:
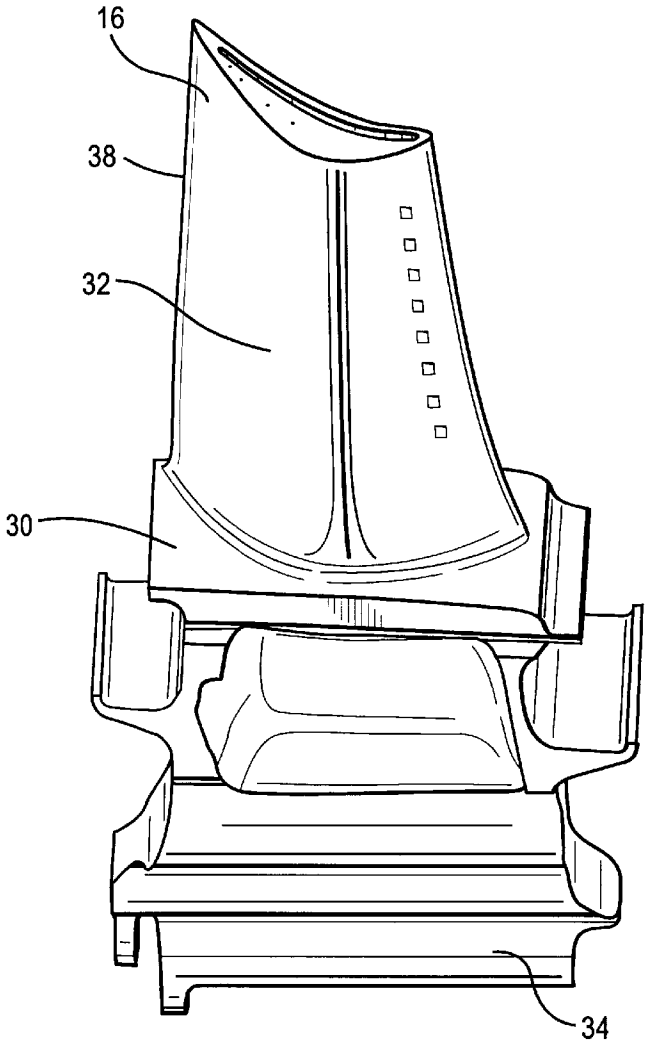
FIG. 3 is a perspective view of the bucket of FIG. 2 and associated platform and dovetail connection as viewed from a generally circumferential direction.
Figure 2:
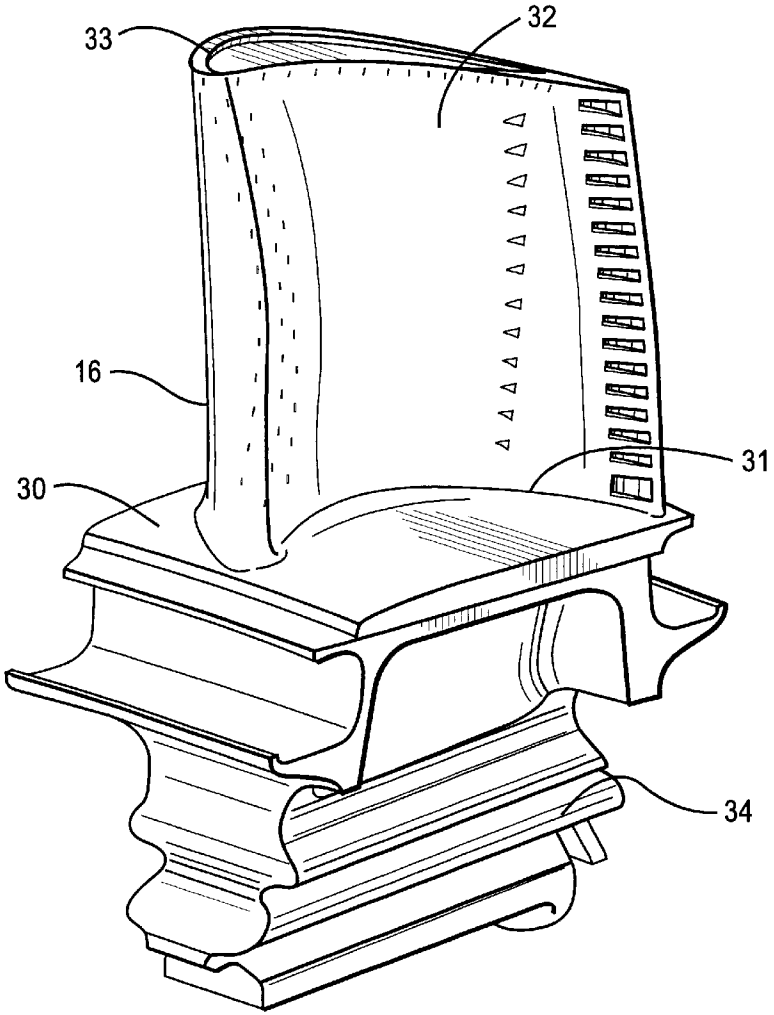
FIG. 2 is a perspective view of a bucket according to a preferred embodiment of the present invention with the bucket airfoil illustrated in conjunction with its platform and its substantially or near axial entry dovetail connection.
Figure 4:
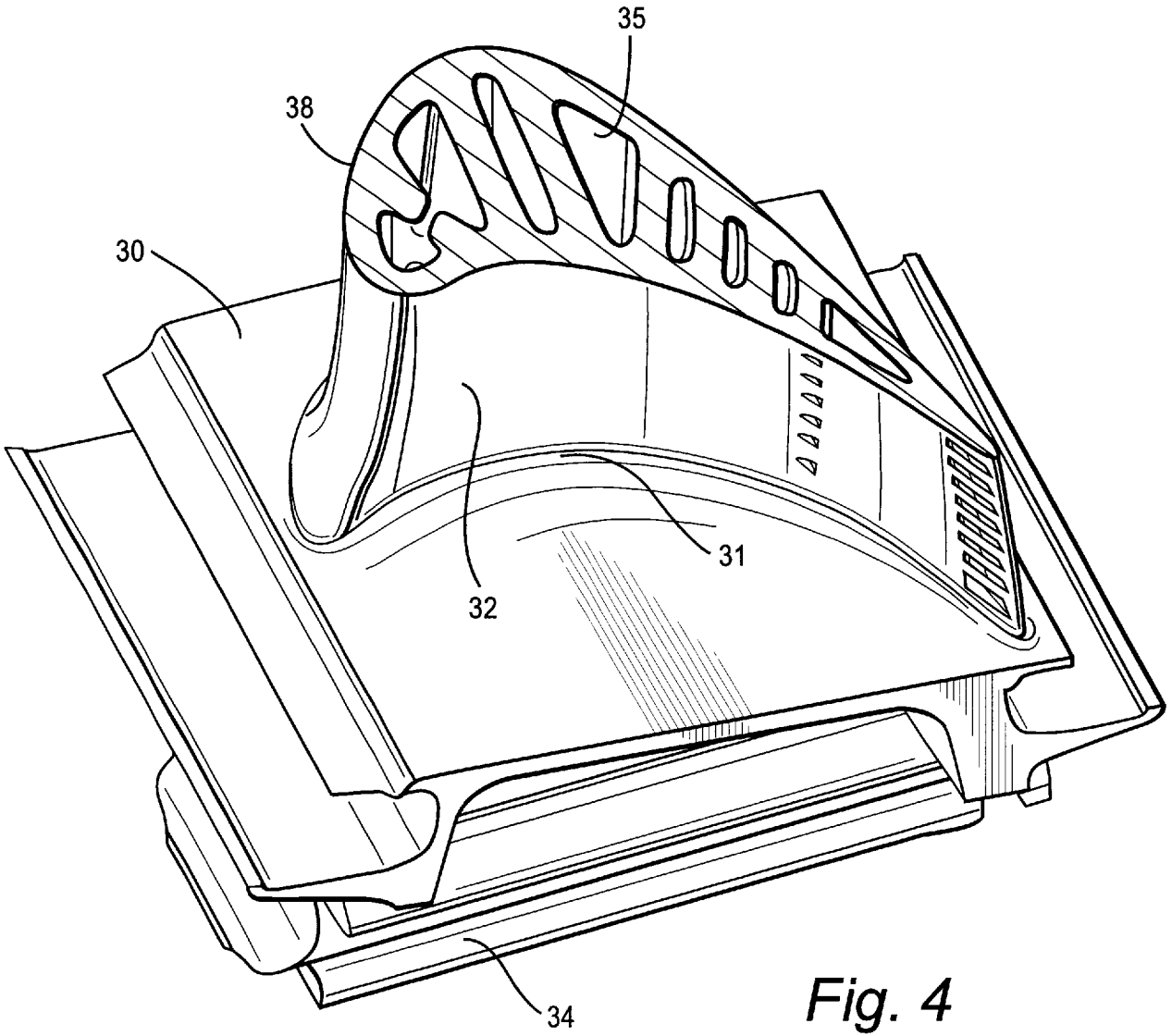
FIG. 4 is a perspective view of the bucket and associated platform and dovetail connection with the bucket airfoil cut and in cross-section to illustrate its cross-sectional profile.

Referring to FIG. 2, it will be appreciated that the buckets, for example, the buckets 16 of the first stage are mounted on a rotor wheel, not shown, forming part of rotor 17 and include platforms 30. Each bucket 16 is provided with a substantially or near axial entry dovetail 34, e.g., about 7 degrees off-axis, for connection with a complementary-shaped mating dovetail, not shown, on the rotor wheel. An axial entry dovetail, however, may be provided with the airfoil profile of this invention. It will also be appreciated that each bucket 16 has a bucket airfoil 32 as illustrated in FIGS. 2–4. Thus, each of the buckets 16 has a bucket airfoil profile at any cross-section from the bucket root 31 to the bucket tip 33 in the shape of an airfoil 32. In this preferred embodiment of a first stage turbine bucket, there are sixty (60) bucket airfoils. The root 31 of the bucket airfoil in a preferred embodiment of the turbine lies at 22.180 inches along a radius from the turbine centerline. This corresponds to the non-dimensional Z value of Table I at Z equals 0.000. The actual height of the bucket 16, that is, the actual Z height of the bucket, is 3.080 inches from root to tip. While not forming part of the present invention, the first stage bucket airfoil 32 includes a plurality of generally serpentine shaped cooling passages 35 forming several air cooling circuits. These air cooling circuits exhaust cooling air into the hot gas path at exit locations adjacent the leading and trailing edges as illustrated.

To define the airfoil shape of each first stage bucket airfoil, there is a unique set or loci of points in space that meet the stage requirements and can be manufactured. This unique loci of points meets the requirements for stage efficiency and are arrived at by iteration between aerodynamic and mechanical loadings enabling the turbine to run in an efficient, safe and smooth manner. The loci which defines the bucket airfoil profile comprises a set of 3600 points relative to the axis of rotation of the turbine. A Cartesian coordinate system of X, Y and Z values given in Table 1 below defines the profile of the bucket airfoil at various locations along its length. The coordinate values for the X and Y coordinates are set forth in inches in Table I although other units of dimensions may be used when the values are appropriately converted. The Z values are set forth in Table I in non-dimensional form from 0 to 1. To convert the Z value to a Z coordinate value, e.g., in inches, the non-dimensional Z value given in the table is multiplied by the height of airfoil in inches. The Cartesian coordinate system has orthogonally-related X, Y and Z axes and the X axis lies parallel to the turbine rotor centerline, i.e., the rotary axis and a positive X coordinate value is axial toward the aft, i.e., exhaust end of the turbine. The positive Y coordinate value extends tangentially in the direction of rotation of the rotor and the positive Z coordinate value is radially outwardly toward the bucket tip.

By defining X and Y coordinate values at selected locations in a Z direction normal to the X, Y plane, the profile section of the bucket airfoil, e.g., the profile section 38 illustrated in FIG. 4, at each Z distance along the length of the airfoil can be ascertained. By connecting the X and Y values with smooth continuing arcs, each profile section 38 at each distance Z is fixed. The airfoil profiles of the various surface locations between the distances Z are determined by smoothly connecting the adjacent profile sections 38 to one another to form the airfoil profile. These values represent the airfoil profiles at ambient, non-operating or non-hot conditions and are for an uncoated airfoil.

The Table I values are generated and shown to three decimal places for determining the profile of the airfoil. There are typical manufacturing tolerances as well as coatings which must be accounted for in the actual profile of the airfoil. Accordingly, the values for the profile given in Table I are for a nominal airfoil. It will therefore be appreciated that ± typical manufacturing tolerances, i.e., ± values, including any coating thicknesses, are additive to the X and Y values given in Table I below. Accordingly, a distance of ±0.040 inches in a direction normal to any surface location along the airfoil profile defines an airfoil profile envelope for this particular bucket airfoil design and turbine, i.e., a range of variation between measured points on the actual airfoil surface at nominal cold or room temperature and the ideal position of those points as given in the Table below at the same temperature. The bucket airfoil design is robust to this range of variation without impairment of mechanical and aerodynamic functions.

The coordinate values given in Table I below provide the preferred nominal profile envelope.

TABLE I

| X | Y | Z' | X | Y | Z' | X | Y | Z' |
|---|---|---|---|---|---|---|---|---|
| −1.200 | 0.041 | 0.000 | 0.304 | 0.611 | 0.000 | 1.081 | −1.566 | 0.000 |
| −1.187 | 0.114 | 0.000 | 0.325 | −0.485 | 0.000 | 1.081 | −1.281 | 0.000 |
| −1.186 | −0.031 | 0.000 | 0.358 | 0.561 | 0.000 | 1.100 | −1.353 | 0.000 |
| −1.158 | 0.182 | 0.000 | 0.382 | −0.533 | 0.000 | 1.118 | −1.425 | 0.000 |

TABLE I-continued

| X | Y | Z' | X | Y | Z' | X | Y | Z' |
|---|---|---|---|---|---|---|---|---|
| −1.141 | −0.088 | 0.000 | 0.408 | 0.506 | 0.000 | 1.136 | −1.496 | 0.000 |
| −1.120 | 0.245 | 0.000 | 0.436 | −0.583 | 0.000 | 1.142 | −1.568 | 0.000 |
| −1.077 | 0.305 | 0.000 | 0.453 | 0.448 | 0.000 | −1.168 | 0.050 | 0.029 |
| −1.076 | −0.122 | 0.000 | 0.488 | −0.635 | 0.000 | −1.160 | −0.023 | 0.029 |
| −1.029 | 0.361 | 0.000 | 0.494 | 0.386 | 0.000 | −1.152 | 0.121 | 0.029 |
| −1.003 | −0.134 | 0.000 | 0.533 | 0.323 | 0.000 | −1.123 | 0.189 | 0.029 |
| −0.977 | 0.414 | 0.000 | 0.538 | −0.690 | 0.000 | −1.121 | −0.085 | 0.029 |
| −0.929 | −0.136 | 0.000 | 0.568 | 0.258 | 0.000 | −1.087 | 0.253 | 0.029 |
| −0.922 | 0.463 | 0.000 | 0.586 | −0.746 | 0.000 | −1.058 | −0.121 | 0.029 |
| −0.864 | 0.509 | 0.000 | 0.601 | 0.192 | 0.000 | −1.046 | 0.314 | 0.029 |
| −0.855 | −0.135 | 0.000 | 0.632 | −0.803 | 0.000 | −1.000 | 0.371 | 0.029 |
| −0.803 | 0.551 | 0.000 | 0.633 | 0.125 | 0.000 | −0.986 | −0.135 | 0.029 |
| −0.781 | −0.136 | 0.000 | 0.662 | 0.058 | 0.000 | −0.950 | 0.425 | 0.029 |
| −0.740 | 0.589 | 0.000 | 0.677 | −0.862 | 0.000 | −0.912 | −0.137 | 0.029 |
| −0.708 | −0.140 | 0.000 | 0.691 | −0.011 | 0.000 | −0.896 | 0.476 | 0.029 |
| −0.675 | 0.624 | 0.000 | 0.718 | −0.079 | 0.000 | −0.840 | 0.523 | 0.029 |
| −0.634 | −0.144 | 0.000 | 0.721 | −0.922 | 0.000 | −0.839 | −0.135 | 0.029 |
| −0.608 | 0.655 | 0.000 | 0.744 | −0.149 | 0.000 | −0.780 | 0.566 | 0.029 |
| −0.560 | −0.151 | 0.000 | 0.763 | −0.983 | 0.000 | −0.765 | −0.134 | 0.029 |
| −0.539 | 0.682 | 0.000 | 0.769 | −0.218 | 0.000 | −0.718 | 0.606 | 0.029 |
| −0.487 | −0.159 | 0.000 | 0.793 | −0.288 | 0.000 | −0.692 | −0.136 | 0.029 |
| −0.469 | 0.706 | 0.000 | 0.803 | −1.045 | 0.000 | −0.654 | 0.642 | 0.029 |
| −0.414 | −0.170 | 0.000 | 0.816 | −0.358 | 0.000 | −0.618 | −0.139 | 0.029 |
| −0.398 | 0.725 | 0.000 | 0.839 | −0.428 | 0.000 | −0.588 | 0.674 | 0.029 |
| −0.341 | −0.182 | 0.000 | 0.842 | −1.108 | 0.000 | −0.545 | −0.144 | 0.029 |
| −0.326 | 0.741 | 0.000 | 0.862 | −0.499 | 0.000 | −0.520 | 0.702 | 0.029 |
| −0.269 | −0.198 | 0.000 | 0.878 | −1.172 | 0.000 | −0.472 | −0.152 | 0.029 |
| −0.253 | 0.752 | 0.000 | 0.883 | −0.569 | 0.000 | −0.451 | 0.726 | 0.029 |
| −0.197 | −0.216 | 0.000 | 0.905 | −0.640 | 0.000 | −0.399 | −0.162 | 0.029 |
| −0.179 | 0.759 | 0.000 | 0.914 | −1.237 | 0.000 | −0.380 | 0.746 | 0.029 |
| −0.126 | −0.238 | 0.000 | 0.926 | −0.711 | 0.000 | −0.326 | −0.175 | 0.029 |
| −0.105 | 0.760 | 0.000 | 0.946 | −0.782 | 0.000 | −0.308 | 0.761 | 0.029 |
| −0.057 | −0.263 | 0.000 | 0.947 | −1.302 | 0.000 | −0.255 | −0.191 | 0.029 |
| −0.031 | 0.754 | 0.000 | 0.966 | −0.853 | 0.000 | −0.235 | 0.770 | 0.029 |
| 0.011 | −0.292 | 0.000 | 0.981 | −1.368 | 0.000 | −0.184 | −0.210 | 0.029 |
| 0.041 | 0.741 | 0.000 | 0.986 | −0.924 | 0.000 | −0.161 | 0.775 | 0.029 |
| 0.078 | −0.324 | 0.000 | 1.006 | −0.996 | 0.000 | −0.114 | −0.233 | 0.029 |
| 0.112 | 0.720 | 0.000 | 1.014 | −1.434 | 0.000 | −0.088 | 0.773 | 0.029 |
| 0.143 | −0.359 | 0.000 | 1.025 | −1.067 | 0.000 | −0.045 | −0.259 | 0.029 |
| 0.180 | 0.691 | 0.000 | 1.044 | −1.138 | 0.000 | −0.015 | 0.764 | 0.029 |
| 0.206 | −0.398 | 0.000 | 1.047 | −1.500 | 0.000 | 0.022 | −0.289 | 0.029 |
| 0.244 | 0.655 | 0.000 | 1.063 | −1.210 | 0.000 | 0.057 | 0.747 | 0.029 |
| 0.267 | −0.440 | 0.000 | 1.081 | −1.566 | 0.000 | 0.088 | −0.323 | 0.029 |
| 0.126 | 0.722 | 0.029 | 1.009 | −1.440 | 0.029 | −0.073 | 0.784 | 0.057 |
| 0.152 | −0.360 | 0.029 | 1.019 | −1.074 | 0.029 | −0.033 | −0.255 | 0.057 |
| 0.192 | 0.690 | 0.029 | 1.038 | −1.145 | 0.029 | 0.000 | 0.772 | 0.057 |
| 0.213 | −0.400 | 0.029 | 1.042 | −1.506 | 0.029 | 0.033 | −0.286 | 0.057 |
| 0.254 | 0.650 | 0.029 | 1.057 | −1.216 | 0.029 | 0.070 | 0.752 | 0.057 |
| 0.273 | −0.443 | 0.029 | 1.075 | −1.287 | 0.029 | 0.097 | −0.321 | 0.057 |
| 0.311 | 0.604 | 0.029 | 1.076 | −1.571 | 0.029 | 0.138 | 0.723 | 0.057 |
| 0.331 | −0.489 | 0.029 | 1.076 | −1.571 | 0.029 | 0.160 | −0.359 | 0.057 |
| 0.363 | 0.552 | 0.029 | 1.093 | −1.358 | 0.029 | 0.202 | 0.688 | 0.057 |
| 0.386 | −0.537 | 0.029 | 1.111 | −1.430 | 0.029 | 0.221 | −0.400 | 0.057 |
| 0.411 | 0.496 | 0.029 | 1.129 | −1.501 | 0.029 | 0.261 | 0.645 | 0.057 |
| 0.439 | −0.588 | 0.029 | 1.136 | −1.572 | 0.029 | 0.279 | −0.445 | 0.057 |
| 0.455 | 0.437 | 0.029 | −1.137 | 0.058 | 0.057 | 0.316 | 0.597 | 0.057 |
| 0.490 | −0.641 | 0.029 | −1.134 | −0.015 | 0.057 | 0.336 | −0.491 | 0.057 |
| 0.495 | 0.375 | 0.029 | −1.119 | 0.129 | 0.057 | 0.367 | 0.544 | 0.057 |
| 0.533 | 0.312 | 0.029 | −1.102 | −0.080 | 0.057 | 0.390 | −0.541 | 0.057 |
| 0.539 | −0.696 | 0.029 | −1.091 | 0.196 | 0.057 | 0.413 | 0.487 | 0.057 |
| 0.568 | 0.247 | 0.029 | −1.057 | 0.261 | 0.057 | 0.442 | −0.592 | 0.057 |
| 0.586 | −0.752 | 0.029 | −1.042 | −0.121 | 0.057 | 0.456 | 0.427 | 0.057 |
| 0.600 | 0.181 | 0.029 | −1.018 | 0.323 | 0.057 | 0.492 | −0.646 | 0.057 |
| 0.631 | 0.114 | 0.029 | −0.974 | 0.381 | 0.057 | 0.495 | 0.365 | 0.057 |
| 0.632 | −0.810 | 0.029 | −0.970 | −0.136 | 0.057 | 0.532 | 0.302 | 0.057 |
| 0.660 | 0.047 | 0.029 | −0.925 | 0.437 | 0.057 | 0.540 | −0.701 | 0.057 |
| 0.676 | −0.869 | 0.029 | −0.897 | −0.138 | 0.057 | 0.566 | 0.237 | 0.057 |
| 0.688 | −0.021 | 0.029 | −0.874 | 0.489 | 0.057 | 0.586 | −0.758 | 0.057 |
| 0.715 | −0.090 | 0.029 | −0.824 | −0.135 | 0.057 | 0.598 | 0.171 | 0.057 |
| 0.719 | −0.928 | 0.029 | −0.818 | 0.537 | 0.057 | 0.629 | 0.105 | 0.057 |
| 0.741 | −0.159 | 0.029 | −0.760 | 0.582 | 0.057 | 0.631 | −0.816 | 0.057 |
| 0.761 | −0.989 | 0.029 | −0.750 | −0.133 | 0.057 | 0.658 | 0.037 | 0.057 |
| 0.766 | −0.228 | 0.029 | −0.700 | 0.623 | 0.057 | 0.675 | −0.875 | 0.057 |
| 0.790 | −0.298 | 0.029 | −0.677 | −0.132 | 0.057 | 0.685 | −0.031 | 0.057 |
| 0.800 | −1.051 | 0.029 | −0.637 | 0.660 | 0.057 | 0.712 | −0.099 | 0.057 |
| 0.813 | −0.367 | 0.029 | −0.604 | −0.134 | 0.057 | 0.717 | −0.935 | 0.057 |
| 0.835 | −0.437 | 0.029 | −0.571 | 0.693 | 0.057 | 0.737 | −0.168 | 0.057 |

TABLE I-continued

| X | Y | Z' | X | Y | Z' | X | Y | Z' |
|---|---|---|---|---|---|---|---|---|
| 0.838 | −1.114 | 0.029 | −0.530 | −0.138 | 0.057 | 0.758 | −0.996 | 0.057 |
| 0.857 | −0.508 | 0.029 | −0.504 | 0.722 | 0.057 | 0.762 | −0.237 | 0.057 |
| 0.875 | −1.178 | 0.029 | −0.458 | −0.145 | 0.057 | 0.786 | −0.306 | 0.057 |
| 0.879 | −0.578 | 0.029 | −0.434 | 0.746 | 0.057 | 0.797 | −1.057 | 0.057 |
| 0.900 | −0.648 | 0.029 | −0.385 | −0.155 | 0.057 | 0.809 | −0.376 | 0.057 |
| 0.909 | −1.243 | 0.029 | −0.364 | 0.765 | 0.057 | 0.831 | −0.445 | 0.057 |
| 0.921 | −0.719 | 0.029 | −0.313 | −0.168 | 0.057 | 0.835 | −1.120 | 0.057 |
| 0.941 | −0.790 | 0.029 | −0.292 | 0.779 | 0.057 | 0.853 | −0.515 | 0.057 |
| 0.943 | −1.309 | 0.029 | −0.241 | −0.184 | 0.057 | 0.871 | −1.184 | 0.057 |
| 0.961 | −0.861 | 0.029 | −0.219 | 0.787 | 0.057 | 0.874 | −0.586 | 0.057 |
| 0.976 | −1.374 | 0.029 | −0.171 | −0.204 | 0.057 | 0.895 | −0.656 | 0.057 |
| 0.981 | −0.932 | 0.029 | −0.146 | 0.789 | 0.057 | 0.905 | −1.249 | 0.057 |
| 1.000 | −1.003 | 0.029 | −0.101 | −0.228 | 0.057 | 0.915 | −0.726 | 0.057 |
| 0.936 | −0.797 | 0.057 | −0.278 | 0.796 | 0.086 | 0.848 | −0.522 | 0.086 |
| 0.938 | −1.314 | 0.057 | −0.229 | −0.176 | 0.086 | 0.866 | −1.190 | 0.086 |
| 0.955 | −0.867 | 0.057 | −0.206 | 0.802 | 0.086 | 0.869 | −0.592 | 0.086 |
| 0.971 | −1.380 | 0.057 | −0.159 | −0.197 | 0.086 | 0.890 | −0.663 | 0.086 |
| 0.975 | −0.938 | 0.057 | −0.133 | 0.802 | 0.086 | 0.900 | −1.254 | 0.086 |
| 0.994 | −1.009 | 0.057 | −0.090 | −0.221 | 0.086 | 0.910 | −0.733 | 0.086 |
| 1.003 | −1.446 | 0.057 | −0.060 | 0.794 | 0.086 | 0.930 | −0.803 | 0.086 |
| 1.013 | −1.080 | 0.057 | −0.023 | −0.250 | 0.086 | 0.933 | −1.320 | 0.086 |
| 1.032 | −1.150 | 0.057 | 0.012 | 0.779 | 0.086 | 0.949 | −0.873 | 0.086 |
| 1.036 | −1.511 | 0.057 | 0.043 | −0.282 | 0.086 | 0.965 | −1.385 | 0.086 |
| 1.050 | −1.221 | 0.057 | 0.081 | 0.755 | 0.086 | 0.969 | −0.944 | 0.086 |
| 1.068 | −1.292 | 0.057 | 0.106 | −0.318 | 0.086 | 0.988 | −1.014 | 0.086 |
| 1.070 | −1.576 | 0.057 | 0.147 | 0.724 | 0.086 | 0.998 | −1.451 | 0.086 |
| 1.070 | −1.576 | 0.057 | 0.168 | −0.358 | 0.086 | 1.007 | −1.085 | 0.086 |
| 1.086 | −1.363 | 0.057 | 0.209 | 0.685 | 0.086 | 1.025 | −1.156 | 0.086 |
| 1.105 | −1.434 | 0.057 | 0.227 | −0.400 | 0.086 | 1.030 | −1.516 | 0.086 |
| 1.122 | −1.506 | 0.057 | 0.266 | 0.640 | 0.086 | 1.043 | −1.226 | 0.086 |
| 1.130 | −1.577 | 0.057 | 0.285 | −0.446 | 0.086 | 1.062 | −1.297 | 0.086 |
| −1.109 | −0.007 | 0.086 | 0.320 | 0.590 | 0.086 | 1.064 | −1.581 | 0.086 |
| −1.108 | 0.066 | 0.086 | 0.340 | −0.493 | 0.086 | 1.064 | −1.581 | 0.086 |
| −1.090 | 0.136 | 0.086 | 0.369 | 0.536 | 0.086 | 1.080 | −1.368 | 0.086 |
| −1.082 | −0.074 | 0.086 | 0.393 | −0.544 | 0.086 | 1.098 | −1.439 | 0.086 |
| −1.063 | 0.204 | 0.086 | 0.414 | 0.479 | 0.086 | 1.115 | −1.510 | 0.086 |
| −1.031 | 0.270 | 0.086 | 0.444 | −0.596 | 0.086 | 1.124 | −1.581 | 0.086 |
| −1.026 | −0.120 | 0.086 | 0.455 | 0.419 | 0.086 | −1.084 | 0.001 | 0.114 |
| −0.993 | 0.332 | 0.086 | 0.493 | −0.650 | 0.086 | −1.081 | 0.074 | 0.114 |
| −0.955 | −0.137 | 0.086 | 0.494 | 0.357 | 0.086 | −1.064 | 0.145 | 0.114 |
| −0.951 | 0.392 | 0.086 | 0.530 | 0.293 | 0.086 | −1.062 | −0.068 | 0.114 |
| −0.904 | 0.448 | 0.086 | 0.541 | −0.706 | 0.036 | −1.038 | 0.213 | 0.114 |
| −0.882 | −0.138 | 0.086 | 0.564 | 0.228 | 0.086 | −1.010 | −0.118 | 0.114 |
| −0.854 | 0.501 | 0.086 | 0.586 | −0.763 | 0.086 | −1.008 | 0.279 | 0.114 |
| −0.809 | −0.135 | 0.086 | 0.595 | 0.163 | 0.086 | −0.971 | 0.342 | 0.114 |
| −0.800 | 0.551 | 0.086 | 0.625 | 0.096 | 0.086 | −0.941 | −0.137 | 0.114 |
| −0.743 | 0.597 | 0.086 | 0.630 | −0.821 | 0.086 | −0.931 | 0.402 | 0.114 |
| −0.736 | −0.131 | 0.086 | 0.654 | 0.029 | 0.086 | −0.886 | 0.460 | 0.114 |
| −0.684 | 0.639 | 0.086 | 0.673 | −0.880 | 0.086 | −0.868 | −0.138 | 0.114 |
| −0.663 | −0.128 | 0.086 | 0.682 | −0.039 | 0.086 | −0.837 | 0.514 | 0.114 |
| −0.621 | 0.677 | 0.086 | 0.708 | −0.107 | 0.086 | −0.795 | −0.134 | 0.114 |
| −0.590 | −0.128 | 0.086 | 0.715 | −0.940 | 0.086 | −0.784 | 0.564 | 0.114 |
| −0.557 | 0.711 | 0.086 | 0.733 | −0.176 | 0.086 | −0.729 | 0.611 | 0.114 |
| −0.517 | −0.131 | 0.086 | 0.755 | −1.001 | 0.086 | −0.723 | −0.129 | 0.114 |
| −0.490 | 0.740 | 0.086 | 0.758 | −0.245 | 0.086 | −0.670 | 0.654 | 0.114 |
| −0.444 | −0.137 | 0.086 | 0.781 | −0.314 | 0.086 | −0.650 | −0.125 | 0.114 |
| −0.421 | 0.764 | 0.086 | 0.794 | −1.063 | 0.086 | −0.609 | 0.693 | 0.114 |
| −0.372 | −0.146 | 0.086 | 0.804 | −0.383 | 0.086 | −0.577 | −0.123 | 0.114 |
| −0.350 | 0.783 | 0.086 | 0.826 | −0.453 | 0.086 | −0.544 | 0.728 | 0.114 |
| −0.300 | −0.160 | 0.086 | 0.831 | −1.126 | 0.086 | −0.504 | −0.124 | 0.114 |
| −0.478 | 0.757 | 0.114 | 0.753 | −0.252 | 0.114 | −0.658 | 0.669 | 0.143 |
| −0.432 | −0.129 | 0.114 | 0.777 | −0.320 | 0.114 | −0.638 | −0.121 | 0.143 |
| −0.409 | 0.781 | 0.114 | 0.790 | −1.068 | 0.114 | −0.597 | 0.709 | 0.143 |
| −0.359 | −0.138 | 0.114 | 0.799 | −0.390 | 0.114 | −0.565 | −0.118 | 0.143 |
| −0.338 | 0.799 | 0.114 | 0.821 | −0.459 | 0.114 | −0.533 | 0.744 | 0.143 |
| −0.288 | −0.151 | 0.114 | 0.827 | −1.131 | 0.114 | −0.493 | −0.118 | 0.143 |
| −0.267 | 0.811 | 0.114 | 0.842 | −0.529 | 0.114 | −0.467 | 0.773 | 0.143 |
| −0.217 | −0.168 | 0.114 | 0.862 | −1.195 | 0.114 | −0.420 | −0.122 | 0.143 |
| −0.194 | 0.815 | 0.114 | 0.863 | −0.599 | 0.114 | −0.398 | 0.797 | 0.143 |
| −0.147 | −0.189 | 0.114 | 0.884 | −0.669 | 0.114 | −0.348 | −0.130 | 0.143 |
| −0.121 | 0.813 | 0.114 | 0.895 | −1.259 | 0.114 | −0.328 | 0.814 | 0.143 |
| −0.079 | −0.215 | 0.114 | 0.904 | −0.739 | 0.114 | −0.277 | −0.143 | 0.143 |
| −0.049 | 0.802 | 0.114 | 0.923 | −0.809 | 0.114 | −0.256 | 0.825 | 0.143 |
| −0.012 | −0.244 | 0.114 | 0.928 | −1.325 | 0.114 | −0.206 | −0.160 | 0.143 |
| 0.021 | 0.784 | 0.114 | 0.943 | −0.879 | 0.114 | −0.183 | 0.827 | 0.143 |
| 0.052 | −0.278 | 0.114 | 0.960 | −1.390 | 0.114 | −0.137 | −0.182 | 0.143 |
| 0.089 | 0.757 | 0.114 | 0.962 | −0.949 | 0.114 | −0.111 | 0.822 | 0.143 |

TABLE I-continued

| X | Y | Z' | X | Y | Z' | X | Y | Z' |
|---|---|---|---|---|---|---|---|---|
| 0.115 | −0.315 | 0.114 | 0.981 | −1.020 | 0.114 | −0.069 | −0.209 | 0.143 |
| 0.153 | 0.723 | 0.114 | 0.992 | −1.455 | 0.114 | −0.040 | 0.809 | 0.143 |
| 0.175 | −0.356 | 0.114 | 1.000 | −1.090 | 0.114 | −0.003 | −0.240 | 0.143 |
| 0.214 | 0.682 | 0.114 | 1.018 | −1.160 | 0.114 | 0.030 | 0.788 | 0.143 |
| 0.233 | −0.400 | 0.114 | 1.024 | −1.521 | 0.114 | 0.060 | −0.274 | 0.143 |
| 0.270 | 0.636 | 0.114 | 1.036 | −1.231 | 0.114 | 0.096 | 0.758 | 0.143 |
| 0.290 | −0.446 | 0.114 | 1.054 | −1.301 | 0.114 | 0.122 | −0.313 | 0.143 |
| 0.321 | 0.584 | 0.114 | 1.058 | −1.585 | 0.114 | 0.159 | 0.722 | 0.143 |
| 0.344 | −0.495 | 0.114 | 1.058 | −1.585 | 0.114 | 0.181 | −0.355 | 0.143 |
| 0.369 | 0.529 | 0.114 | 1.072 | −1.372 | 0.114 | 0.217 | 0.679 | 0.143 |
| 0.396 | −0.546 | 0.114 | 1.090 | −1.443 | 0.114 | 0.239 | −0.399 | 0.143 |
| 0.413 | 0.471 | 0.114 | 1.108 | −1.513 | 0.114 | 0.272 | 0.631 | 0.143 |
| 0.446 | −0.599 | 0.114 | 1.117 | −1.584 | 0.114 | 0.294 | −0.447 | 0.143 |
| 0.454 | 0.411 | 0.114 | −1.061 | 0.011 | 0.143 | 0.322 | 0.578 | 0.143 |
| 0.492 | 0.349 | 0.114 | −1.057 | 0.083 | 0.143 | 0.347 | −0.496 | 0.143 |
| 0.494 | −0.653 | 0.114 | −1.043 | −0.059 | 0.143 | 0.369 | 0.523 | 0.143 |
| 0.527 | 0.285 | 0.114 | −1.040 | 0.154 | 0.143 | 0.398 | −0.548 | 0.143 |
| 0.541 | −0.709 | 0.114 | −1.017 | 0.222 | 0.143 | 0.412 | 0.464 | 0.143 |
| 0.561 | 0.220 | 0.114 | −0.996 | −0.114 | 0.143 | 0.447 | −0.602 | 0.143 |
| 0.585 | −0.767 | 0.114 | −0.987 | 0.289 | 0.143 | 0.452 | 0.404 | 0.143 |
| 0.592 | 0.155 | 0.114 | −0.952 | 0.352 | 0.143 | 0.489 | 0.341 | 0.143 |
| 0.622 | 0.088 | 0.114 | −0.928 | −0.137 | 0.143 | 0.494 | −0.657 | 0.143 |
| 0.629 | −0.825 | 0.114 | −0.913 | 0.413 | 0.143 | 0.524 | 0.278 | 0.143 |
| 0.650 | 0.021 | 0.114 | −0.869 | 0.471 | 0.143 | 0.540 | −0.713 | 0.143 |
| 0.671 | −0.885 | 0.114 | −0.855 | −0.137 | 0.143 | 0.557 | 0.213 | 0.143 |
| 0.677 | −0.047 | 0.114 | −0.821 | 0.526 | 0.143 | 0.584 | −0.771 | 0.143 |
| 0.704 | −0.114 | 0.114 | −0.783 | −0.132 | 0.143 | 0.588 | 0.147 | 0.143 |
| 0.712 | −0.945 | 0.114 | −0.770 | 0.577 | 0.143 | 0.617 | 0.081 | 0.143 |
| 0.729 | −0.183 | 0.114 | −0.716 | 0.625 | 0.143 | 0.627 | −0.830 | 0.143 |
| 0.752 | −1.006 | 0.114 | −0.710 | −0.126 | 0.143 | 0.646 | 0.014 | 0.143 |
| 0.668 | −0.889 | 0.143 | −0.844 | −0.136 | 0.171 | 0.553 | 0.205 | 0.171 |
| 0.673 | −0.054 | 0.143 | −0.807 | 0.539 | 0.171 | 0.581 | −0.775 | 0.171 |
| 0.699 | −0.121 | 0.143 | −0.772 | −0.130 | 0.171 | 0.584 | 0.140 | 0.171 |
| 0.708 | −0.950 | 0.143 | −0.757 | 0.591 | 0.171 | 0.613 | 0.074 | 0.171 |
| 0.724 | −0.190 | 0.143 | −0.703 | 0.639 | 0.171 | 0.623 | −0.834 | 0.171 |
| 0.748 | −1.011 | 0.143 | −0.700 | −0.123 | 0.171 | 0.641 | 0.007 | 0.171 |
| 0.748 | −0.258 | 0.143 | −0.646 | 0.684 | 0.171 | 0.664 | −0.894 | 0.171 |
| 0.771 | −0.327 | 0.143 | −0.627 | −0.117 | 0.171 | 0.668 | −0.061 | 0.171 |
| 0.785 | −1.073 | 0.143 | −0.586 | 0.724 | 0.171 | 0.694 | −0.128 | 0.171 |
| 0.794 | −0.396 | 0.143 | −0.555 | −0.114 | 0.171 | 0.704 | −0.954 | 0.171 |
| 0.815 | −0.465 | 0.143 | −0.522 | 0.759 | 0.171 | 0.718 | −0.196 | 0.171 |
| 0.822 | −1.136 | 0.143 | −0.483 | −0.113 | 0.171 | 0.742 | −0.265 | 0.171 |
| 0.837 | −0.535 | 0.143 | −0.456 | 0.789 | 0.171 | 0.743 | −1.016 | 0.171 |
| 0.856 | −1.199 | 0.143 | −0.410 | −0.116 | 0.171 | 0.765 | −0.333 | 0.171 |
| 0.857 | −0.604 | 0.143 | −0.388 | 0.812 | 0.171 | 0.780 | −1.078 | 0.171 |
| 0.877 | −0.674 | 0.143 | −0.338 | −0.124 | 0.171 | 0.788 | −0.402 | 0.171 |
| 0.890 | −1.264 | 0.143 | −0.317 | 0.828 | 0.171 | 0.809 | −0.471 | 0.171 |
| 0.897 | −0.744 | 0.143 | −0.267 | −0.137 | 0.171 | 0.816 | −1.140 | 0.171 |
| 0.917 | −0.814 | 0.143 | −0.245 | 0.837 | 0.171 | 0.830 | −0.541 | 0.171 |
| 0.922 | −1.329 | 0.143 | −0.197 | −0.155 | 0.171 | 0.851 | −0.610 | 0.171 |
| 0.936 | −0.884 | 0.143 | −0.173 | 0.838 | 0.171 | 0.851 | −1.204 | 0.171 |
| 0.954 | −1.394 | 0.143 | −0.128 | −0.177 | 0.171 | 0.871 | −0.680 | 0.171 |
| 0.955 | −0.954 | 0.143 | −0.101 | 0.831 | 0.171 | 0.884 | −1.269 | 0.171 |
| 0.974 | −1.024 | 0.143 | −0.061 | −0.205 | 0.171 | 0.890 | −0.749 | 0.171 |
| 0.986 | −1.460 | 0.143 | −0.031 | 0.815 | 0.171 | 0.910 | −0.819 | 0.171 |
| 0.993 | −1.094 | 0.143 | 0.004 | −0.236 | 0.171 | 0.916 | −1.333 | 0.171 |
| 1.011 | −1.165 | 0.143 | 0.038 | 0.790 | 0.171 | 0.929 | −0.889 | 0.171 |
| 1.018 | −1.525 | 0.143 | 0.067 | −0.272 | 0.171 | 0.947 | −1.399 | 0.171 |
| 1.029 | −1.235 | 0.143 | 0.103 | 0.759 | 0.171 | 0.948 | −0.959 | 0.171 |
| 1.047 | −1.305 | 0.143 | 0.128 | −0.312 | 0.171 | 0.967 | −1.029 | 0.171 |
| 1.052 | −1.589 | 0.143 | 0.164 | 0.720 | 0.171 | 0.979 | −1.464 | 0.171 |
| 1.052 | −1.589 | 0.143 | 0.186 | −0.355 | 0.171 | 0.985 | −1.099 | 0.171 |
| 1.065 | −1.376 | 0.143 | 0.221 | 0.675 | 0.171 | 1.003 | −1.169 | 0.171 |
| 1.083 | −1.446 | 0.143 | 0.242 | −0.400 | 0.171 | 1.011 | −1.529 | 0.171 |
| 1.100 | −1.517 | 0.143 | 0.274 | 0.626 | 0.171 | 1.021 | −1.239 | 0.171 |
| 1.110 | −1.587 | 0.143 | 0.296 | −0.448 | 0.171 | 1.039 | −1.309 | 0.171 |
| −1.039 | 0.021 | 0.171 | 0.323 | 0.572 | 0.171 | 1.045 | −1.593 | 0.171 |
| −1.035 | 0.094 | 0.171 | 0.348 | −0.499 | 0.171 | 1.045 | −1.593 | 0.171 |
| −1.024 | −0.049 | 0.171 | 0.368 | 0.516 | 0.171 | 1.057 | −1.379 | 0.171 |
| −1.020 | 0.164 | 0.171 | 0.398 | −0.551 | 0.171 | 1.075 | −1.449 | 0.171 |
| −0.997 | 0.233 | 0.171 | 0.410 | 0.457 | 0.171 | 1.092 | −1.520 | 0.171 |
| −0.982 | −0.107 | 0.171 | 0.447 | −0.605 | 0.171 | 1.103 | −1.590 | 0.171 |
| −0.969 | 0.300 | 0.171 | 0.450 | 0.396 | 0.171 | −1.020 | 0.034 | 0.200 |
| −0.935 | 0.364 | 0.171 | 0.486 | 0.334 | 0.171 | −1.016 | 0.106 | 0.200 |
| −0.916 | −0.135 | 0.171 | 0.493 | −0.660 | 0.171 | −1.007 | −0.037 | 0.200 |
| −0.897 | 0.425 | 0.171 | 0.521 | 0.270 | 0.171 | −1.001 | 0.177 | 0.200 |
| −0.854 | 0.483 | 0.171 | 0.538 | −0.717 | 0.171 | −0.979 | 0.246 | 0.200 |

TABLE I-continued

| X | Y | Z' | X | Y | Z' | X | Y | Z' |
|---|---|---|---|---|---|---|---|---|
| −0.969 | −0.097 | 0.200 | 0.445 | −0.610 | 0.200 | 1.095 | −1.593 | 0.200 |
| −0.952 | 0.312 | 0.200 | 0.447 | 0.389 | 0.200 | −1.002 | 0.050 | 0.229 |
| −0.919 | 0.377 | 0.200 | 0.483 | 0.326 | 0.200 | −0.998 | 0.121 | 0.229 |
| −0.906 | −0.131 | 0.200 | 0.491 | −0.665 | 0.200 | −0.991 | −0.021 | 0.229 |
| −0.881 | 0.438 | 0.200 | 0.517 | 0.262 | 0.200 | −0.984 | 0.192 | 0.229 |
| −0.839 | 0.497 | 0.200 | 0.535 | −0.722 | 0.200 | −0.963 | 0.261 | 0.229 |
| −0.834 | −0.133 | 0.200 | 0.549 | 0.198 | 0.200 | −0.957 | −0.084 | 0.229 |
| −0.793 | 0.552 | 0.200 | 0.578 | −0.780 | 0.200 | −0.936 | 0.327 | 0.229 |
| −0.762 | −0.126 | 0.200 | 0.579 | 0.132 | 0.200 | −0.903 | 0.391 | 0.229 |
| −0.744 | 0.605 | 0.200 | 0.608 | 0.066 | 0.200 | −0.898 | −0.123 | 0.229 |
| −0.691 | −0.119 | 0.200 | 0.619 | −0.839 | 0.200 | −0.866 | 0.452 | 0.229 |
| −0.690 | 0.653 | 0.200 | 0.636 | −0.001 | 0.200 | −0.827 | −0.130 | 0.229 |
| −0.634 | 0.698 | 0.200 | 0.660 | −0.899 | 0.200 | −0.824 | 0.511 | 0.229 |
| −0.619 | −0.113 | 0.200 | 0.662 | −0.068 | 0.200 | −0.779 | 0.567 | 0.229 |
| −0.574 | 0.739 | 0.200 | 0.688 | −0.135 | 0.200 | −0.755 | −0.122 | 0.229 |
| −0.547 | −0.110 | 0.200 | 0.699 | −0.960 | 0.200 | −0.730 | 0.619 | 0.229 |
| −0.511 | 0.774 | 0.200 | 0.712 | −0.203 | 0.200 | −0.684 | −0.116 | 0.229 |
| −0.474 | −0.109 | 0.200 | 0.736 | −0.271 | 0.200 | −0.677 | 0.668 | 0.229 |
| −0.445 | 0.803 | 0.200 | 0.738 | −1.021 | 0.200 | −0.621 | 0.713 | 0.229 |
| −0.402 | −0.112 | 0.200 | 0.759 | −0.340 | 0.200 | −0.612 | −0.110 | 0.229 |
| −0.377 | 0.826 | 0.200 | 0.775 | −1.083 | 0.200 | −0.561 | 0.753 | 0.229 |
| −0.331 | −0.120 | 0.200 | 0.781 | −0.409 | 0.200 | −0.540 | −0.106 | 0.229 |
| −0.306 | 0.841 | 0.200 | 0.803 | −0.477 | 0.200 | −0.498 | 0.788 | 0.229 |
| −0.260 | −0.133 | 0.200 | 0.811 | −1.145 | 0.200 | −0.469 | −0.106 | 0.229 |
| −0.234 | 0.848 | 0.200 | 0.823 | −0.547 | 0.200 | −0.433 | 0.817 | 0.229 |
| −0.190 | −0.151 | 0.200 | 0.844 | −0.616 | 0.200 | −0.397 | −0.110 | 0.229 |
| −0.162 | 0.847 | 0.200 | 0.845 | −1.209 | 0.200 | −0.364 | 0.838 | 0.229 |
| −0.122 | −0.175 | 0.200 | 0.864 | −0.685 | 0.200 | −0.325 | −0.119 | 0.229 |
| −0.091 | 0.837 | 0.200 | 0.878 | −1.273 | 0.200 | −0.294 | 0.853 | 0.229 |
| −0.055 | −0.203 | 0.200 | 0.883 | −0.755 | 0.200 | −0.255 | −0.132 | 0.229 |
| −0.021 | 0.819 | 0.200 | 0.903 | −0.824 | 0.200 | −0.222 | 0.859 | 0.229 |
| 0.009 | −0.236 | 0.200 | 0.909 | −1.338 | 0.200 | −0.186 | −0.151 | 0.229 |
| 0.046 | 0.792 | 0.200 | 0.922 | −0.894 | 0.200 | −0.150 | 0.856 | 0.229 |
| 0.071 | −0.273 | 0.200 | 0.940 | −0.963 | 0.200 | −0.118 | −0.176 | 0.229 |
| 0.109 | 0.758 | 0.200 | 0.941 | −1.403 | 0.200 | −0.080 | 0.843 | 0.229 |
| 0.131 | −0.313 | 0.200 | 0.959 | −1.033 | 0.200 | −0.052 | −0.205 | 0.229 |
| 0.169 | 0.717 | 0.200 | 0.972 | −1.468 | 0.200 | −0.011 | 0.822 | 0.229 |
| 0.188 | −0.357 | 0.200 | 0.977 | −1.103 | 0.200 | 0.011 | −0.238 | 0.229 |
| 0.224 | 0.670 | 0.200 | 0.996 | −1.173 | 0.200 | 0.055 | 0.792 | 0.229 |
| 0.244 | −0.403 | 0.200 | 1.004 | −1.532 | 0.200 | 0.073 | −0.276 | 0.229 |
| 0.275 | 0.620 | 0.200 | 1.013 | −1.243 | 0.200 | 0.116 | 0.756 | 0.229 |
| 0.297 | −0.452 | 0.200 | 1.031 | −1.313 | 0.200 | 0.132 | −0.317 | 0.229 |
| 0.323 | 0.566 | 0.200 | 1.038 | −1.596 | 0.200 | 0.174 | 0.713 | 0.229 |
| 0.348 | −0.503 | 0.200 | 1.038 | −1.596 | 0.200 | 0.188 | −0.361 | 0.229 |
| 0.367 | 0.509 | 0.200 | 1.049 | −1.383 | 0.200 | 0.228 | 0.665 | 0.229 |
| 0.397 | −0.555 | 0.200 | 1.067 | −1.452 | 0.200 | 0.243 | −0.408 | 0.229 |
| 0.409 | 0.449 | 0.200 | 1.084 | −1.522 | 0.200 | 0.278 | 0.613 | 0.229 |
| 0.295 | −0.457 | 0.229 | 1.023 | −1.316 | 0.229 | 0.130 | −0.323 | 0.257 |
| 0.324 | 0.558 | 0.229 | 1.031 | −1.600 | 0.229 | 0.180 | 0.708 | 0.257 |
| 0.346 | −0.508 | 0.229 | 1.031 | −1.600 | 0.229 | 0.186 | −0.368 | 0.257 |
| 0.367 | 0.501 | 0.229 | 1.040 | −1.386 | 0.229 | 0.232 | 0.659 | 0.257 |
| 0.394 | −0.561 | 0.229 | 1.058 | −1.455 | 0.229 | 0.240 | −0.415 | 0.257 |
| 0.407 | 0.441 | 0.229 | 1.075 | −1.525 | 0.229 | 0.280 | 0.606 | 0.257 |
| 0.441 | −0.616 | 0.229 | 1.087 | −1.595 | 0.229 | 0.291 | −0.465 | 0.257 |
| 0.445 | 0.380 | 0.229 | −0.986 | 0.067 | 0.257 | 0.325 | 0.551 | 0.257 |
| 0.480 | 0.318 | 0.229 | −0.983 | 0.138 | 0.257 | 0.341 | −0.516 | 0.257 |
| 0.486 | −0.672 | 0.229 | −0.976 | −0.004 | 0.257 | 0.367 | 0.492 | 0.257 |
| 0.514 | 0.254 | 0.229 | −0.969 | 0.209 | 0.257 | 0.389 | −0.569 | 0.257 |
| 0.530 | −0.729 | 0.229 | −0.948 | 0.277 | 0.257 | 0.406 | 0.433 | 0.257 |
| 0.545 | 0.189 | 0.229 | −0.946 | −0.068 | 0.257 | 0.435 | −0.624 | 0.257 |
| 0.572 | −0.787 | 0.229 | −0.921 | 0.343 | 0.257 | 0.443 | 0.371 | 0.257 |
| 0.575 | 0.124 | 0.229 | −0.891 | −0.113 | 0.257 | 0.478 | 0.308 | 0.257 |
| 0.603 | 0.058 | 0.229 | −0.888 | 0.407 | 0.257 | 0.480 | −0.679 | 0.257 |
| 0.614 | −0.846 | 0.229 | −0.851 | 0.468 | 0.257 | 0.510 | 0.245 | 0.257 |
| 0.631 | −0.009 | 0.229 | −0.821 | −0.125 | 0.257 | 0.524 | −0.736 | 0.257 |
| 0.654 | −0.905 | 0.229 | −0.809 | 0.526 | 0.257 | 0.541 | 0.180 | 0.257 |
| 0.657 | −0.076 | 0.229 | −0.764 | 0.581 | 0.257 | 0.566 | −0.794 | 0.257 |
| 0.682 | −0.143 | 0.229 | −0.750 | −0.117 | 0.257 | 0.570 | 0.115 | 0.257 |
| 0.693 | −0.965 | 0.229 | −0.715 | 0.633 | 0.257 | 0.598 | 0.049 | 0.257 |
| 0.706 | −0.211 | 0.229 | −0.679 | −0.111 | 0.257 | 0.607 | −0.853 | 0.257 |
| 0.730 | −0.279 | 0.229 | −0.662 | 0.682 | 0.257 | 0.625 | −0.017 | 0.257 |
| 0.731 | −1.026 | 0.229 | −0.607 | −0.106 | 0.257 | 0.647 | −0.912 | 0.257 |
| 0.752 | −0.347 | 0.229 | −0.606 | 0.727 | 0.257 | 0.651 | −0.084 | 0.257 |
| 0.768 | −1.088 | 0.229 | −0.547 | 0.767 | 0.257 | 0.676 | −0.151 | 0.257 |
| 0.774 | −0.415 | 0.229 | −0.536 | −0.103 | 0.257 | 0.686 | −0.972 | 0.257 |
| 0.796 | −0.484 | 0.229 | −0.485 | 0.801 | 0.257 | 0.700 | −0.219 | 0.257 |
| 0.804 | −1.150 | 0.229 | −0.464 | −0.104 | 0.257 | 0.723 | −0.286 | 0.257 |

TABLE I-continued

| X | Y | Z' | X | Y | Z' | X | Y | Z' |
|---|---|---|---|---|---|---|---|---|
| 0.816 | −0.553 | 0.229 | −0.419 | 0.829 | 0.257 | 0.724 | −1.033 | 0.257 |
| 0.836 | −0.622 | 0.229 | −0.393 | −0.109 | 0.257 | 0.745 | −0.354 | 0.257 |
| 0.838 | −1.214 | 0.229 | −0.350 | 0.850 | 0.257 | 0.761 | −1.094 | 0.257 |
| 0.856 | −0.691 | 0.229 | −0.322 | −0.119 | 0.257 | 0.767 | −0.422 | 0.257 |
| 0.871 | −1.278 | 0.229 | −0.280 | 0.863 | 0.257 | 0.788 | −0.491 | 0.257 |
| 0.876 | −0.760 | 0.229 | −0.252 | −0.134 | 0.257 | 0.797 | −1.156 | 0.257 |
| 0.895 | −0.829 | 0.229 | −0.209 | 0.868 | 0.257 | 0.809 | −0.559 | 0.257 |
| 0.903 | −1.342 | 0.229 | −0.184 | −0.154 | 0.257 | 0.829 | −0.628 | 0.257 |
| 0.914 | −0.899 | 0.229 | −0.137 | 0.862 | 0.257 | 0.831 | −1.219 | 0.257 |
| 0.933 | −0.968 | 0.229 | −0.117 | −0.179 | 0.257 | 0.848 | −0.697 | 0.257 |
| 0.934 | −1.407 | 0.229 | −0.068 | 0.847 | 0.257 | 0.864 | −1.282 | 0.257 |
| 0.951 | −1.038 | 0.229 | −0.052 | −0.209 | 0.257 | 0.868 | −0.766 | 0.257 |
| 0.965 | −1.471 | 0.229 | 0.000 | 0.823 | 0.257 | 0.887 | −0.835 | 0.257 |
| 0.969 | −1.107 | 0.229 | 0.011 | −0.244 | 0.257 | 0.895 | −1.347 | 0.257 |
| 0.987 | −1.177 | 0.229 | 0.064 | 0.791 | 0.257 | 0.906 | −0.904 | 0.257 |
| 0.997 | −1.536 | 0.229 | 0.072 | −0.282 | 0.257 | 0.924 | −0.973 | 0.257 |
| 1.005 | −1.246 | 0.229 | 0.124 | 0.753 | 0.257 | 0.927 | −1.411 | 0.257 |
| 0.943 | −1.042 | 0.257 | −0.052 | −0.214 | 0.286 | 0.860 | −0.771 | 0.286 |
| 0.958 | −1.475 | 0.257 | 0.010 | −0.249 | 0.286 | 0.878 | −0.840 | 0.286 |
| 0.961 | −1.111 | 0.257 | 0.010 | 0.824 | 0.286 | 0.888 | −1.351 | 0.286 |
| 0.979 | −1.181 | 0.257 | 0.070 | −0.288 | 0.286 | 0.897 | −0.909 | 0.286 |
| 0.990 | −1.539 | 0.257 | 0.071 | 0.790 | 0.286 | 0.916 | −0.978 | 0.286 |
| 0.996 | −1.250 | 0.257 | 0.127 | −0.330 | 0.286 | 0.919 | −1.415 | 0.286 |
| 1.014 | −1.319 | 0.257 | 0.131 | 0.749 | 0.286 | 0.934 | −1.046 | 0.286 |
| 1.023 | −1.603 | 0.257 | 0.182 | −0.375 | 0.286 | 0.950 | −1.479 | 0.286 |
| 1.023 | −1.603 | 0.257 | 0.186 | 0.703 | 0.286 | 0.952 | −1.115 | 0.286 |
| 1.031 | −1.389 | 0.257 | 0.235 | −0.423 | 0.286 | 0.970 | −1.184 | 0.286 |
| 1.049 | −1.458 | 0.257 | 0.236 | 0.653 | 0.286 | 0.982 | −1.542 | 0.286 |
| 1.066 | −1.528 | 0.257 | 0.283 | 0.599 | 0.286 | 0.987 | −1.253 | 0.286 |
| 1.079 | −1.597 | 0.257 | 0.286 | −0.473 | 0.286 | 1.005 | −1.322 | 0.286 |
| −0.972 | 0.085 | 0.286 | 0.326 | 0.542 | 0.286 | 1.015 | −1.606 | 0.286 |
| −0.969 | 0.156 | 0.286 | 0.336 | −0.524 | 0.286 | 1.015 | −1.606 | 0.286 |
| −0.963 | 0.014 | 0.286 | 0.367 | 0.484 | 0.266 | 1.022 | −1.391 | 0.286 |
| −0.955 | 0.225 | 0.286 | 0.383 | −0.577 | 0.286 | 1.040 | −1.461 | 0.286 |
| −0.935 | −0.051 | 0.286 | 0.405 | 0.424 | 0.286 | 1.057 | −1.530 | 0.286 |
| −0.934 | 0.293 | 0.286 | 0.429 | −0.632 | 0.286 | 1.070 | −1.599 | 0.286 |
| −0.907 | 0.359 | 0.286 | 0.441 | 0.362 | 0.286 | −0.959 | 0.101 | 0.314 |
| −0.884 | −0.100 | 0.286 | 0.473 | −0.687 | 0.286 | −0.956 | 0.172 | 0.314 |
| −0.874 | 0.422 | 0.286 | 0.474 | 0.299 | 0.286 | −0.949 | 0.031 | 0.314 |
| −0.837 | 0.483 | 0.286 | 0.506 | 0.236 | 0.286 | −0.942 | 0.241 | 0.314 |
| −0.816 | −0.117 | 0.286 | 0.517 | −0.744 | 0.286 | −0.923 | −0.035 | 0.314 |
| −0.795 | 0.541 | 0.286 | 0.537 | 0.171 | 0.286 | −0.921 | 0.309 | 0.314 |
| −0.750 | 0.596 | 0.286 | 0.558 | −0.802 | 0.286 | −0.893 | 0.374 | 0.314 |
| −0.745 | −0.111 | 0.286 | 0.565 | 0.106 | 0.286 | −0.875 | −0.087 | 0.314 |
| −0.701 | 0.648 | 0.286 | 0.593 | 0.040 | 0.286 | −0.861 | 0.437 | 0.314 |
| −0.674 | −0.104 | 0.286 | 0.599 | −0.860 | 0.286 | −0.824 | 0.497 | 0.314 |
| −0.648 | 0.696 | 0.286 | 0.619 | −0.026 | 0.286 | −0.809 | −0.109 | 0.314 |
| −0.603 | −0.100 | 0.286 | 0.639 | −0.919 | 0.286 | −0.782 | 0.555 | 0.314 |
| −0.593 | 0.740 | 0.286 | 0.645 | −0.092 | 0.286 | −0.738 | −0.103 | 0.314 |
| −0.533 | 0.780 | 0.286 | 0.669 | −0.159 | 0.286 | −0.737 | 0.609 | 0.314 |
| −0.532 | −0.098 | 0.286 | 0.678 | −0.979 | 0.286 | −0.688 | 0.661 | 0.314 |
| −0.471 | 0.814 | 0.286 | 0.693 | −0.226 | 0.286 | −0.668 | −0.096 | 0.314 |
| −0.460 | −0.100 | 0.286 | 0.716 | −0.294 | 0.286 | −0.636 | 0.709 | 0.314 |
| −0.405 | 0.841 | 0.286 | 0.716 | −1.039 | 0.286 | −0.597 | −0.092 | 0.314 |
| −0.390 | −0.107 | 0.286 | 0.738 | −0.362 | 0.286 | −0.580 | 0.752 | 0.314 |
| −0.337 | 0.861 | 0.286 | 0.753 | −1.100 | 0.286 | −0.526 | −0.091 | 0.314 |
| −0.319 | −0.118 | 0.286 | 0.760 | −0.430 | 0.286 | −0.521 | 0.792 | 0.314 |
| −0.267 | 0.873 | 0.286 | 0.781 | −0.498 | 0.286 | −0.458 | 0.825 | 0.314 |
| −0.250 | −0.135 | 0.286 | 0.789 | −1.161 | 0.286 | −0.455 | −0.094 | 0.314 |
| −0.196 | 0.875 | 0.286 | 0.801 | −0.566 | 0.286 | −0.393 | 0.852 | 0.314 |
| −0.182 | −0.157 | 0.286 | 0.821 | −0.634 | 0.286 | −0.385 | −0.103 | 0.314 |
| −0.125 | 0.868 | 0.286 | 0.823 | −1.224 | 0.286 | −0.325 | 0.871 | 0.314 |
| −0.116 | −0.183 | 0.286 | 0.840 | −0.703 | 0.286 | −0.315 | −0.116 | 0.314 |
| −0.056 | 0.850 | 0.286 | 0.856 | −1.287 | 0.286 | −0.254 | 0.881 | 0.314 |
| −0.247 | −0.134 | 0.314 | 0.781 | −1.166 | 0.314 | −0.447 | 0.835 | 0.343 |
| −0.184 | 0.882 | 0.314 | 0.793 | −0.572 | 0.314 | −0.381 | 0.861 | 0.343 |
| −0.180 | −0.157 | 0.314 | 0.813 | −0.640 | 0.314 | −0.379 | −0.096 | 0.343 |
| −0.115 | −0.185 | 0.314 | 0.815 | −1.228 | 0.314 | −0.313 | 0.879 | 0.343 |
| −0.113 | 0.872 | 0.314 | 0.832 | −0.708 | 0.314 | −0.310 | −0.111 | 0.343 |
| −0.052 | −0.218 | 0.314 | 0.848 | −1.291 | 0.314 | −0.243 | 0.888 | 0.343 |
| −0.045 | 0.852 | 0.314 | 0.851 | −0.776 | 0.314 | −0.243 | −0.131 | 0.343 |
| 0.009 | −0.254 | 0.314 | 0.870 | −0.845 | 0.314 | −0.177 | −0.156 | 0.343 |
| 0.019 | 0.823 | 0.314 | 0.880 | −1.354 | 0.314 | −0.173 | 0.887 | 0.343 |
| 0.068 | −0.294 | 0.314 | 0.889 | −0.913 | 0.314 | −0.113 | −0.186 | 0.343 |
| 0.080 | 0.787 | 0.314 | 0.907 | −0.982 | 0.314 | −0.103 | 0.874 | 0.343 |
| 0.125 | −0.336 | 0.314 | 0.911 | −1.418 | 0.314 | −0.051 | −0.220 | 0.343 |
| 0.137 | 0.745 | 0.314 | 0.925 | −1.050 | 0.314 | −0.036 | 0.852 | 0.343 |

TABLE I-continued

| X | Y | Z' | X | Y | Z' | X | Y | Z' |
|---|---|---|---|---|---|---|---|---|
| 0.179 | −0.382 | 0.314 | 0.943 | −1.482 | 0.314 | 0.009 | −0.257 | 0.343 |
| 0.190 | 0.697 | 0.314 | 0.943 | −1.119 | 0.314 | 0.027 | 0.822 | 0.343 |
| 0.231 | −0.430 | 0.314 | 0.961 | −1.188 | 0.314 | 0.067 | −0.298 | 0.343 |
| 0.239 | 0.646 | 0.314 | 0.974 | −1.545 | 0.314 | 0.087 | 0.784 | 0.343 |
| 0.282 | −0.480 | 0.314 | 0.978 | −1.256 | 0.314 | 0.122 | −0.341 | 0.343 |
| 0.284 | 0.591 | 0.314 | 0.996 | −1.325 | 0.314 | 0.142 | 0.740 | 0.343 |
| 0.327 | 0.535 | 0.314 | 1.007 | −1.608 | 0.314 | 0.176 | −0.388 | 0.343 |
| 0.330 | −0.531 | 0.314 | 1.007 | −1.608 | 0.314 | 0.193 | 0.691 | 0.343 |
| 0.366 | 0.476 | 0.314 | 1.013 | −1.394 | 0.314 | 0.227 | −0.436 | 0.343 |
| 0.377 | −0.585 | 0.314 | 1.030 | −1.463 | 0.314 | 0.241 | 0.639 | 0.343 |
| 0.403 | 0.415 | 0.314 | 1.047 | −1.531 | 0.314 | 0.277 | −0.486 | 0.343 |
| 0.422 | −0.639 | 0.314 | 1.061 | −1.600 | 0.314 | 0.285 | 0.584 | 0.343 |
| 0.438 | 0.353 | 0.314 | −0.947 | 0.116 | 0.343 | 0.325 | −0.538 | 0.343 |
| 0.466 | −0.695 | 0.314 | −0.944 | 0.186 | 0.343 | 0.326 | 0.527 | 0.343 |
| 0.471 | 0.291 | 0.314 | −0.937 | 0.046 | 0.343 | 0.364 | 0.468 | 0.343 |
| 0.502 | 0.227 | 0.314 | −0.930 | 0.256 | 0.343 | 0.371 | −0.591 | 0.343 |
| 0.509 | −0.751 | 0.314 | −0.911 | −0.019 | 0.343 | 0.401 | 0.407 | 0.343 |
| 0.532 | 0.163 | 0.314 | −0.909 | 0.323 | 0.343 | 0.416 | −0.646 | 0.343 |
| 0.551 | −0.809 | 0.314 | −0.881 | 0.388 | 0.343 | 0.435 | 0.345 | 0.343 |
| 0.560 | 0.098 | 0.314 | −0.866 | −0.073 | 0.343 | 0.460 | −0.701 | 0.343 |
| 0.587 | 0.032 | 0.314 | −0.849 | 0.451 | 0.343 | 0.467 | 0.282 | 0.343 |
| 0.592 | −0.867 | 0.314 | −0.812 | 0.511 | 0.343 | 0.498 | 0.219 | 0.343 |
| 0.613 | −0.034 | 0.314 | −0.801 | −0.099 | 0.343 | 0.502 | −0.758 | 0.343 |
| 0.631 | −0.925 | 0.314 | −0.770 | 0.568 | 0.343 | 0.527 | 0.154 | 0.343 |
| 0.638 | −0.100 | 0.314 | −0.731 | −0.095 | 0.343 | 0.543 | −0.815 | 0.343 |
| 0.663 | −0.167 | 0.314 | −0.725 | 0.622 | 0.343 | 0.554 | 0.090 | 0.343 |
| 0.670 | −0.984 | 0.314 | −0.676 | 0.673 | 0.343 | 0.581 | 0.024 | 0.343 |
| 0.686 | −0.234 | 0.314 | −0.661 | −0.087 | 0.343 | 0.584 | −0.873 | 0.343 |
| 0.708 | −1.044 | 0.314 | −0.624 | 0.720 | 0.343 | 0.607 | −0.042 | 0.343 |
| 0.709 | −0.301 | 0.314 | −0.590 | −0.083 | 0.343 | 0.624 | −0.931 | 0.343 |
| 0.731 | −0.368 | 0.314 | −0.568 | 0.764 | 0.343 | 0.632 | −0.108 | 0.343 |
| 0.745 | −1.105 | 0.314 | −0.520 | −0.082 | 0.343 | 0.656 | −0.174 | 0.343 |
| 0.752 | −0.436 | 0.314 | −0.509 | 0.802 | 0.343 | 0.663 | −0.990 | 0.343 |
| 0.773 | −0.504 | 0.314 | −0.449 | −0.087 | 0.343 | 0.679 | −0.241 | 0.343 |
| 0.700 | −1.049 | 0.343 | −0.613 | 0.731 | 0.371 | 0.600 | −0.049 | 0.371 |
| 0.701 | −0.308 | 0.343 | −0.582 | −0.072 | 0.371 | 0.616 | −0.936 | 0.371 |
| 0.723 | −0.375 | 0.343 | −0.558 | 0.774 | 0.371 | 0.625 | −0.115 | 0.371 |
| 0.737 | −1.110 | 0.343 | −0.512 | −0.072 | 0.371 | 0.648 | −0.181 | 0.371 |
| 0.744 | −0.442 | 0.343 | −0.499 | 0.812 | 0.371 | 0.654 | −0.995 | 0.371 |
| 0.764 | −0.510 | 0.343 | −0.442 | −0.077 | 0.371 | 0.671 | −0.248 | 0.371 |
| 0.773 | −1.171 | 0.343 | −0.436 | 0.844 | 0.371 | 0.692 | −1.054 | 0.371 |
| 0.784 | −0.578 | 0.343 | −0.373 | −0.089 | 0.371 | 0.693 | −0.314 | 0.371 |
| 0.804 | −0.645 | 0.343 | −0.371 | 0.870 | 0.371 | 0.715 | −0.381 | 0.371 |
| 0.807 | −1.232 | 0.343 | −0.304 | −0.105 | 0.371 | 0.729 | −1.114 | 0.371 |
| 0.823 | −0.713 | 0.343 | −0.303 | 0.887 | 0.371 | 0.736 | −0.448 | 0.371 |
| 0.840 | −1.295 | 0.343 | −0.238 | −0.127 | 0.371 | 0.756 | −0.516 | 0.371 |
| 0.842 | −0.781 | 0.343 | −0.233 | 0.894 | 0.371 | 0.765 | −1.174 | 0.371 |
| 0.861 | −0.849 | 0.343 | −0.173 | −0.154 | 0.371 | 0.776 | −0.583 | 0.371 |
| 0.872 | −1.358 | 0.343 | −0.163 | 0.890 | 0.371 | 0.796 | −0.650 | 0.371 |
| 0.880 | −0.917 | 0.343 | −0.110 | −0.185 | 0.371 | 0.799 | −1.236 | 0.371 |
| 0.898 | −0.986 | 0.343 | −0.094 | 0.876 | 0.371 | 0.815 | −0.718 | 0.371 |
| 0.903 | −1.421 | 0.343 | −0.049 | −0.221 | 0.371 | 0.832 | −1.298 | 0.371 |
| 0.916 | −1.054 | 0.343 | −0.028 | 0.852 | 0.371 | 0.834 | −0.786 | 0.371 |
| 0.934 | −1.122 | 0.343 | 0.010 | −0.260 | 0.371 | 0.852 | −0.853 | 0.371 |
| 0.934 | −1.484 | 0.343 | 0.034 | 0.819 | 0.371 | 0.864 | −1.360 | 0.371 |
| 0.951 | −1.190 | 0.343 | 0.066 | −0.301 | 0.371 | 0.871 | −0.921 | 0.371 |
| 0.966 | −1.547 | 0.343 | 0.092 | 0.780 | 0.371 | 0.889 | −0.989 | 0.371 |
| 0.969 | −1.259 | 0.343 | 0.120 | −0.346 | 0.371 | 0.395 | −1.423 | 0.371 |
| 0.986 | −1.327 | 0.343 | 0.146 | 0.735 | 0.371 | 0.907 | −1.057 | 0.371 |
| 0.999 | −1.610 | 0.343 | 0.173 | −0.393 | 0.371 | 0.925 | −1.125 | 0.371 |
| 0.999 | −1.610 | 0.343 | 0.196 | 0.685 | 0.371 | 0.926 | −1.486 | 0.371 |
| 1.003 | −1.396 | 0.343 | 0.223 | −0.441 | 0.371 | 0.942 | −1.193 | 0.371 |
| 1.021 | −1.464 | 0.343 | 0.242 | 0.632 | 0.371 | 0.958 | −1.549 | 0.371 |
| 1.038 | −1.533 | 0.343 | 0.272 | −0.492 | 0.371 | 0.959 | −1.261 | 0.371 |
| 1.052 | −1.601 | 0.343 | 0.285 | 0.577 | 0.371 | 0.977 | −1.329 | 0.371 |
| −0.935 | 0.130 | 0.371 | 0.319 | −0.544 | 0.371 | 0.990 | −1.611 | 0.371 |
| −0.932 | 0.200 | 0.371 | 0.325 | 0.519 | 0.371 | 0.990 | −1.611 | 0.371 |
| −0.925 | 0.061 | 0.371 | 0.363 | 0.460 | 0.371 | 0.994 | −1.397 | 0.371 |
| −0.919 | 0.269 | 0.371 | 0.365 | −0.597 | 0.371 | 1.011 | −1.466 | 0.371 |
| −0.899 | −0.004 | 0.371 | 0.398 | 0.399 | 0.371 | 1.028 | −1.534 | 0.371 |
| −0.898 | 0.336 | 0.371 | 0.410 | −0.652 | 0.371 | 1.042 | −1.602 | 0.371 |
| −0.870 | 0.401 | 0.371 | 0.431 | 0.337 | 0.371 | −0.924 | 0.144 | 0.400 |
| −0.855 | −0.058 | 0.371 | 0.453 | −0.707 | 0.371 | −0.922 | 0.214 | 0.400 |
| −0.838 | 0.463 | 0.371 | 0.463 | 0.274 | 0.371 | −0.914 | 0.075 | 0.400 |
| −0.801 | 0.523 | 0.371 | 0.493 | 0.211 | 0.371 | −0.908 | 0.282 | 0.400 |
| −0.792 | −0.088 | 0.371 | 0.495 | −0.764 | 0.371 | −0.887 | 0.010 | 0.400 |
| −0.759 | 0.580 | 0.371 | 0.521 | 0.146 | 0.371 | −0.887 | 0.349 | 0.400 |

TABLE I-continued

| X | Y | Z' | X | Y | Z' | X | Y | Z' |
|---|---|---|---|---|---|---|---|---|
| −0.722 | −0.085 | 0.371 | 0.536 | −0.821 | 0.371 | −0.860 | 0.413 | 0.400 |
| −0.714 | 0.634 | 0.371 | 0.549 | 0.082 | 0.371 | −0.844 | −0.044 | 0.400 |
| −0.666 | 0.694 | 0.371 | 0.575 | 0.016 | 0.371 | −0.827 | 0.475 | 0.400 |
| −0.652 | −0.076 | 0.371 | 0.576 | −0.878 | 0.371 | −0.790 | 0.534 | 0.400 |
| −0.782 | −0.075 | 0.400 | 0.488 | 0.203 | 0.400 | −0.878 | 0.361 | 0.429 |
| −0.749 | 0.591 | 0.400 | 0.516 | 0.138 | 0.400 | −0.876 | 0.025 | 0.429 |
| −0.712 | −0.073 | 0.400 | 0.528 | −0.826 | 0.400 | −0.850 | 0.425 | 0.429 |
| −0.704 | 0.644 | 0.400 | 0.543 | 0.074 | 0.400 | −0.832 | −0.029 | 0.429 |
| −0.655 | 0.694 | 0.400 | 0.568 | −0.893 | 0.400 | −0.818 | 0.487 | 0.429 |
| −0.643 | −0.064 | 0.400 | 0.569 | 0.009 | 0.400 | −0.780 | 0.545 | 0.429 |
| −0.603 | 0.741 | 0.400 | 0.593 | −0.057 | 0.400 | −0.771 | −0.061 | 0.429 |
| −0.573 | −0.060 | 0.400 | 0.608 | −0.941 | 0.400 | −0.739 | 0.601 | 0.429 |
| −0.547 | 0.783 | 0.400 | 0.618 | −0.122 | 0.400 | −0.702 | −0.059 | 0.429 |
| −0.503 | −0.060 | 0.400 | 0.641 | −0.188 | 0.400 | −0.694 | 0.654 | 0.429 |
| −0.488 | 0.821 | 0.400 | 0.646 | −1.000 | 0.400 | −0.645 | 0.704 | 0.429 |
| −0.434 | −0.067 | 0.400 | 0.663 | −0.254 | 0.400 | −0.633 | −0.050 | 0.429 |
| −0.426 | 0.852 | 0.400 | 0.684 | −1.058 | 0.400 | −0.593 | 0.750 | 0.429 |
| −0.365 | −0.080 | 0.400 | 0.685 | −0.321 | 0.400 | −0.563 | −0.047 | 0.429 |
| −0.360 | 0.877 | 0.400 | 0.707 | −0.387 | 0.400 | −0.537 | 0.792 | 0.429 |
| −0.297 | −0.098 | 0.400 | 0.721 | −1.118 | 0.400 | −0.494 | −0.048 | 0.429 |
| −0.292 | 0.892 | 0.400 | 0.727 | −0.454 | 0.400 | −0.478 | 0.828 | 0.429 |
| −0.232 | −0.122 | 0.400 | 0.748 | −0.521 | 0.400 | −0.424 | −0.056 | 0.429 |
| −0.223 | 0.898 | 0.400 | 0.756 | −1.178 | 0.400 | −0.416 | 0.859 | 0.429 |
| −0.168 | −0.151 | 0.400 | 0.767 | −0.588 | 0.400 | −0.356 | −0.071 | 0.429 |
| −0.153 | 0.893 | 0.400 | 0.787 | −0.655 | 0.400 | −0.350 | 0.882 | 0.429 |
| −0.107 | −0.185 | 0.400 | 0.791 | −1.239 | 0.400 | −0.290 | −0.091 | 0.429 |
| −0.085 | 0.877 | 0.400 | 0.806 | −0.723 | 0.400 | −0.282 | 0.897 | 0.429 |
| −0.047 | −0.222 | 0.400 | 0.824 | −1.301 | 0.400 | −0.226 | −0.118 | 0.429 |
| −0.020 | 0.851 | 0.400 | 0.825 | −0.790 | 0.400 | −0.213 | 0.901 | 0.429 |
| 0.010 | −0.262 | 0.400 | 0.843 | −0.857 | 0.400 | −0.163 | −0.149 | 0.429 |
| 0.041 | 0.816 | 0.400 | 0.855 | −1.363 | 0.400 | −0.144 | 0.894 | 0.429 |
| 0.065 | −0.305 | 0.400 | 0.861 | −0.925 | 0.400 | −0.103 | −0.184 | 0.429 |
| 0.098 | 0.775 | 0.400 | 0.880 | −0.993 | 0.400 | −0.077 | 0.876 | 0.429 |
| 0.118 | −0.350 | 0.400 | 0.887 | −1.426 | 0.400 | −0.045 | −0.222 | 0.429 |
| 0.150 | 0.729 | 0.400 | 0.897 | −1.060 | 0.400 | −0.013 | 0.848 | 0.429 |
| 0.170 | −0.398 | 0.400 | 0.915 | −1.128 | 0.400 | 0.010 | −0.264 | 0.429 |
| 0.198 | 0.679 | 0.400 | 0.918 | −1.488 | 0.400 | 0.047 | 0.813 | 0.429 |
| 0.219 | −0.447 | 0.400 | 0.933 | −1.195 | 0.400 | 0.064 | −0.308 | 0.429 |
| 0.243 | 0.625 | 0.400 | 0.949 | −1.551 | 0.400 | 0.102 | 0.770 | 0.429 |
| 0.267 | −0.498 | 0.400 | 0.950 | −1.263 | 0.400 | 0.116 | −0.354 | 0.429 |
| 0.285 | 0.569 | 0.400 | 0.967 | −1.331 | 0.400 | 0.153 | 0.723 | 0.429 |
| 0.314 | −0.550 | 0.400 | 0.981 | −1.613 | 0.400 | 0.167 | −0.402 | 0.429 |
| 0.324 | 0.511 | 0.400 | 0.981 | −1.613 | 0.400 | 0.200 | 0.672 | 0.429 |
| 0.359 | −0.603 | 0.400 | 0.984 | −1.399 | 0.400 | 0.215 | −0.452 | 0.429 |
| 0.360 | 0.451 | 0.400 | 1.001 | −1.467 | 0.400 | 0.244 | 0.618 | 0.429 |
| 0.395 | 0.391 | 0.400 | 1.018 | −1.535 | 0.400 | 0.262 | −0.503 | 0.429 |
| 0.403 | −0.658 | 0.400 | 1.033 | −1.603 | 0.400 | 0.285 | 0.561 | 0.429 |
| 0.428 | 0.329 | 0.400 | −0.914 | 0.157 | 0.429 | 0.308 | −0.556 | 0.429 |
| 0.446 | −0.713 | 0.400 | −0.912 | 0.226 | 0.429 | 0.323 | 0.503 | 0.429 |
| 0.458 | 0.266 | 0.400 | −0.903 | 0.088 | 0.429 | 0.353 | −0.609 | 0.429 |
| 0.487 | −0.769 | 0.400 | −0.899 | 0.295 | 0.429 | 0.358 | 0.443 | 0.429 |
| 0.392 | 0.382 | 0.429 | 1.008 | −1.535 | 0.429 | 0.258 | −0.508 | 0.457 |
| 0.396 | −0.664 | 0.429 | 1.023 | −1.603 | 0.429 | 0.284 | 0.554 | 0.457 |
| 0.424 | 0.320 | 0.429 | −0.904 | 0.169 | 0.457 | 0.303 | −0.561 | 0.457 |
| 0.438 | −0.719 | 0.429 | −0.902 | 0.239 | 0.457 | 0.321 | 0.495 | 0.457 |
| 0.454 | 0.258 | 0.420 | −0.892 | 0.101 | 0.457 | 0.347 | −0.615 | 0.457 |
| 0.480 | −0.775 | 0.429 | −0.890 | 0.307 | 0.457 | 0.356 | 0.435 | 0.457 |
| 0.483 | 0.194 | 0.429 | −0.869 | 0.373 | 0.457 | 0.389 | 0.374 | 0.457 |
| 0.510 | 0.130 | 0.429 | −0.864 | 0.038 | 0.457 | 0.389 | −0.669 | 0.457 |
| 0.520 | −0.831 | 0.429 | −0.841 | 0.436 | 0.457 | 0.420 | 0.312 | 0.457 |
| 0.537 | 0.066 | 0.429 | −0.820 | −0.015 | 0.457 | 0.431 | −0.724 | 0.457 |
| 0.560 | −0.889 | 0.429 | −0.809 | 0.497 | 0.457 | 0.449 | 0.250 | 0.457 |
| 0.562 | 0.001 | 0.429 | −0.771 | 0.555 | 0.457 | 0.472 | −0.780 | 0.457 |
| 0.587 | −0.064 | 0.429 | −0.759 | −0.046 | 0.457 | 0.478 | 0.187 | 0.457 |
| 0.599 | −0.946 | 0.429 | −0.730 | 0.611 | 0.457 | 0.504 | 0.123 | 0.457 |
| 0.610 | −0.129 | 0.429 | −0.690 | −0.044 | 0.457 | 0.513 | −0.836 | 0.457 |
| 0.633 | −0.195 | 0.429 | −0.685 | 0.663 | 0.457 | 0.530 | 0.059 | 0.457 |
| 0.638 | −1.004 | 0.429 | −0.636 | 0.712 | 0.457 | 0.552 | −0.893 | 0.457 |
| 0.656 | −0.261 | 0.429 | −0.621 | −0.035 | 0.457 | 0.555 | −0.006 | 0.457 |
| 0.676 | −1.062 | 0.429 | −0.584 | 0.758 | 0.457 | 0.580 | −0.071 | 0.457 |
| 0.677 | −0.327 | 0.429 | −0.552 | −0.032 | 0.457 | 0.591 | −0.950 | 0.457 |
| 0.698 | −0.393 | 0.429 | −0.528 | 0.799 | 0.457 | 0.603 | −0.136 | 0.457 |
| 0.712 | −1.122 | 0.429 | −0.483 | −0.034 | 0.457 | 0.626 | −0.202 | 0.457 |
| 0.719 | −0.460 | 0.429 | −0.469 | 0.835 | 0.457 | 0.630 | −1.008 | 0.457 |
| 0.739 | −0.527 | 0.429 | −0.414 | −0.044 | 0.457 | 0.648 | −0.267 | 0.457 |
| 0.748 | −1.181 | 0.429 | −0.406 | 0.865 | 0.457 | 0.667 | −1.066 | 0.457 |
| 0.759 | −0.593 | 0.429 | −0.347 | −0.061 | 0.457 | 0.669 | −0.333 | 0.457 |

TABLE I-continued

| X | Y | Z' | X | Y | Z' | X | Y | Z' |
|---|---|---|---|---|---|---|---|---|
| 0.778 | −0.660 | 0.429 | −0.341 | 0.887 | 0.457 | 0.690 | −0.399 | 0.457 |
| 0.782 | −1.242 | 0.429 | −0.282 | −0.084 | 0.457 | 0.704 | −1.125 | 0.457 |
| 0.797 | −0.727 | 0.429 | −0.273 | 0.900 | 0.457 | 0.710 | −0.465 | 0.457 |
| 0.815 | −1.303 | 0.429 | −0.219 | −0.112 | 0.457 | 0.730 | −0.532 | 0.457 |
| 0.816 | −0.794 | 0.429 | −0.204 | 0.903 | 0.457 | 0.739 | −1.184 | 0.457 |
| 0.834 | −0.861 | 0.429 | −0.158 | −0.145 | 0.457 | 0.750 | −0.598 | 0.457 |
| 0.847 | −1.365 | 0.429 | −0.135 | 0.894 | 0.457 | 0.769 | −0.665 | 0.457 |
| 0.852 | −0.928 | 0.429 | −0.099 | −0.182 | 0.457 | 0.773 | −1.245 | 0.457 |
| 0.870 | −0.996 | 0.429 | −0.069 | 0.875 | 0.457 | 0.788 | −0.731 | 0.457 |
| 0.878 | −1.427 | 0.429 | −0.043 | −0.223 | 0.457 | 0.806 | −1.305 | 0.457 |
| 0.888 | −1.063 | 0.429 | −0.006 | 0.845 | 0.457 | 0.806 | −0.798 | 0.457 |
| 0.905 | −1.130 | 0.429 | 0.011 | −0.266 | 0.457 | 0.825 | −0.865 | 0.457 |
| 0.909 | −1.490 | 0.429 | 0.052 | 0.808 | 0.457 | 0.838 | −1.367 | 0.457 |
| 0.923 | −1.198 | 0.429 | 0.064 | −0.311 | 0.457 | 0.843 | −0.932 | 0.457 |
| 0.940 | −1.265 | 0.429 | 0.106 | 0.765 | 0.457 | 0.861 | −0.999 | 0.457 |
| 0.940 | −1.552 | 0.429 | 0.115 | −0.358 | 0.457 | 0.869 | −1.429 | 0.457 |
| 0.957 | −1.333 | 0.429 | 0.156 | 0.717 | 0.457 | 0.878 | −1.065 | 0.457 |
| 0.973 | −1.614 | 0.429 | 0.164 | −0.407 | 0.457 | 0.896 | −1.132 | 0.457 |
| 0.973 | −1.614 | 0.429 | 0.202 | 0.665 | 0.457 | 0.900 | −1.491 | 0.457 |
| 0.974 | −1.400 | 0.429 | 0.211 | −0.457 | 0.457 | 0.913 | −1.200 | 0.457 |
| 0.991 | −1.468 | 0.429 | 0.244 | 0.610 | 0.457 | 0.930 | −1.267 | 0.457 |
| 0.931 | −1.553 | 0.457 | 0.113 | −0.360 | 0.486 | 0.860 | −1.430 | 0.436 |
| 0.947 | −1.334 | 0.457 | 0.158 | 0.711 | 0.486 | 0.869 | −1.068 | 0.486 |
| 0.963 | −1.614 | 0.457 | 0.162 | −0.409 | 0.486 | 0.886 | −1.134 | 0.486 |
| 0.963 | −1.614 | 0.457 | 0.203 | 0.658 | 0.486 | 0.891 | −1.491 | 0.486 |
| 0.964 | −1.401 | 0.457 | 0.208 | −0.460 | 0.486 | 0.903 | −1.201 | 0.486 |
| 0.981 | −1.468 | 0.457 | 0.244 | 0.603 | 0.486 | 0.920 | −1.268 | 0.486 |
| 0.998 | −1.535 | 0.457 | 0.254 | −0.512 | 0.486 | 0.922 | −1.553 | 0.486 |
| 1.013 | −1.603 | 0.457 | 0.283 | 0.546 | 0.486 | 0.937 | −1.334 | 0.486 |
| −0.895 | 0.181 | 0.486 | 0.298 | −0.565 | 0.486 | 0.954 | −1.614 | 0.486 |
| −0.894 | 0.250 | 0.486 | 0.319 | 0.487 | 0.486 | 0.954 | −1.614 | 0.486 |
| −0.882 | 0.317 | 0.486 | 0.341 | −0.619 | 0.486 | 0.954 | −1.401 | 0.486 |
| −0.881 | 0.114 | 0.486 | 0.353 | 0.428 | 0.486 | 0.971 | −1.468 | 0.486 |
| −0.861 | 0.383 | 0.486 | 0.383 | −0.673 | 0.486 | 0.987 | −1.535 | 0.486 |
| −0.852 | 0.052 | 0.486 | 0.385 | 0.367 | 0.486 | 1.003 | −1.602 | 0.486 |
| −0.834 | 0.446 | 0.486 | 0.415 | 0.305 | 0.486 | −0.887 | 0.260 | 0.514 |
| −0.807 | 0.000 | 0.486 | 0.425 | −0.728 | 0.486 | −0.886 | 0.191 | 0.514 |
| −0.801 | 0.507 | 0.486 | 0.444 | 0.242 | 0.486 | −0.875 | 0.327 | 0.514 |
| −0.764 | 0.565 | 0.486 | 0.465 | −0.784 | 0.486 | −0.871 | 0.124 | 0.514 |
| −0.745 | −0.030 | 0.486 | 0.472 | 0.179 | 0.486 | −0.855 | 0.393 | 0.514 |
| −0.722 | 0.620 | 0.486 | 0.498 | 0.116 | 0.486 | −0.839 | 0.064 | 0.514 |
| −0.677 | 0.672 | 0.486 | 0.505 | −0.840 | 0.486 | −0.828 | 0.456 | 0.514 |
| −0.677 | −0.027 | 0.486 | 0.524 | 0.051 | 0.486 | −0.795 | 0.516 | 0.514 |
| −0.628 | 0.720 | 0.486 | 0.544 | −0.897 | 0.486 | −0.793 | 0.014 | 0.514 |
| −0.608 | −0.019 | 0.486 | 0.548 | −0.013 | 0.486 | −0.758 | 0.573 | 0.514 |
| −0.576 | 0.765 | 0.486 | 0.572 | −0.078 | 0.486 | −0.730 | −0.013 | 0.514 |
| −0.539 | −0.016 | 0.486 | 0.583 | −0.954 | 0.486 | −0.716 | 0.628 | 0.514 |
| −0.520 | 0.805 | 0.486 | 0.595 | −0.143 | 0.486 | −0.671 | 0.679 | 0.514 |
| −0.471 | −0.020 | 0.486 | 0.618 | −0.208 | 0.486 | −0.662 | −0.009 | 0.514 |
| −0.461 | 0.841 | 0.486 | 0.621 | −1.011 | 0.486 | −0.622 | 0.727 | 0.514 |
| −0.403 | −0.031 | 0.486 | 0.640 | −0.273 | 0.486 | −0.594 | 0.000 | 0.514 |
| −0.399 | 0.970 | 0.486 | 0.659 | −1.069 | 0.486 | −0.569 | 0.771 | 0.514 |
| −0.336 | −0.050 | 0.486 | 0.661 | −0.339 | 0.486 | −0.526 | 0.002 | 0.514 |
| −0.333 | 0.891 | 0.486 | 0.682 | −0.404 | 0.486 | −0.513 | 0.811 | 0.514 |
| −0.272 | −0.075 | 0.486 | 0.695 | −1.127 | 0.486 | −0.457 | −0.004 | 0.514 |
| −0.265 | 0.903 | 0.486 | 0.702 | −0.470 | 0.486 | −0.454 | 0.846 | 0.514 |
| −0.211 | −0.105 | 0.486 | 0.722 | −0.536 | 0.486 | −0.392 | 0.874 | 0.514 |
| −0.196 | 0.904 | 0.486 | 0.730 | −1.186 | 0.486 | −0.390 | −0.016 | 0.514 |
| −0.151 | −0.141 | 0.486 | 0.741 | −0.602 | 0.486 | −0.326 | 0.894 | 0.514 |
| −0.128 | 0.894 | 0.486 | 0.760 | −0.669 | 0.486 | −0.325 | −0.037 | 0.514 |
| −0.095 | −0.180 | 0.486 | 0.765 | −1.246 | 0.486 | −0.262 | −0.065 | 0.514 |
| −0.062 | 0.873 | 0.486 | 0.779 | −0.735 | 0.486 | −0.258 | 0.904 | 0.514 |
| −0.040 | −0.222 | 0.486 | 0.797 | −0.801 | 0.486 | −0.201 | −0.097 | 0.514 |
| −0.001 | 0.842 | 0.486 | 0.797 | −1.307 | 0.486 | −0.190 | 0.904 | 0.514 |
| 0.013 | −0.266 | 0.486 | 0.815 | −0.868 | 0.486 | −0.144 | −0.135 | 0.514 |
| 0.057 | 0.804 | 0.486 | 0.829 | −1.368 | 0.486 | −0.122 | 0.893 | 0.514 |
| 0.064 | −0.312 | 0.486 | 0.833 | −0.934 | 0.486 | −0.089 | −0.175 | 0.514 |
| 0.109 | 0.760 | 0.486 | 0.851 | −1.001 | 0.486 | −0.058 | 0.871 | 0.514 |
| −0.036 | −0.219 | 0.514 | 0.787 | −0.804 | 0.514 | −0.191 | −0.088 | 0.543 |
| 0.003 | 0.839 | 0.514 | 0.788 | −1.308 | 0.514 | −0.186 | 0.904 | 0.543 |
| 0.016 | −0.264 | 0.514 | 0.805 | −0.870 | 0.514 | −0.135 | −0.127 | 0.543 |
| 0.059 | 0.800 | 0.514 | 0.820 | −1.369 | 0.514 | −0.119 | 0.892 | 0.543 |
| 0.066 | −0.311 | 0.514 | 0.823 | −0.936 | 0.514 | −0.081 | −0.169 | 0.543 |
| 0.111 | 0.755 | 0.514 | 0.841 | −1.003 | 0.514 | −0.055 | 0.868 | 0.543 |
| 0.114 | −0.360 | 0.514 | 0.851 | −1.430 | 0.514 | −0.030 | −0.213 | 0.543 |
| 0.159 | 0.705 | 0.514 | 0.858 | −1.069 | 0.514 | 0.005 | 0.835 | 0.543 |
| 0.161 | −0.410 | 0.514 | 0.876 | −1.135 | 0.514 | 0.020 | −0.260 | 0.543 |

TABLE I-continued

| X | Y | Z' | X | Y | Z' | X | Y | Z' |
|---|---|---|---|---|---|---|---|---|
| 0.202 | 0.652 | 0.514 | 0.881 | −1.491 | 0.514 | 0.061 | 0.795 | 0.543 |
| 0.206 | −0.461 | 0.514 | 0.893 | −1.202 | 0.514 | 0.069 | −0.308 | 0.543 |
| 0.243 | 0.597 | 0.514 | 0.910 | −1.268 | 0.514 | 0.111 | 0.750 | 0.543 |
| 0.251 | −0.514 | 0.514 | 0.912 | −1.552 | 0.514 | 0.116 | −0.358 | 0.543 |
| 0.280 | 0.539 | 0.514 | 0.927 | −1.335 | 0.514 | 0.158 | 0.700 | 0.543 |
| 0.294 | −0.567 | 0.514 | 0.944 | −1.401 | 0.514 | 0.161 | −0.409 | 0.543 |
| 0.316 | 0.481 | 0.514 | 0.944 | −1.613 | 0.514 | 0.201 | 0.647 | 0.543 |
| 0.337 | −0.621 | 0.514 | 0.944 | −1.613 | 0.514 | 0.206 | −0.461 | 0.543 |
| 0.349 | 0.421 | 0.514 | 0.960 | −1.468 | 0.514 | 0.240 | 0.591 | 0.543 |
| 0.378 | −0.675 | 0.514 | 0.977 | −1.534 | 0.514 | 0.249 | −0.513 | 0.543 |
| 0.380 | 0.360 | 0.514 | 0.992 | −1.601 | 0.514 | 0.277 | 0.534 | 0.543 |
| 0.410 | 0.298 | 0.514 | −0.880 | 0.268 | 0.543 | 0.292 | −0.567 | 0.543 |
| 0.419 | −0.730 | 0.514 | −0.878 | 0.200 | 0.543 | 0.312 | 0.475 | 0.543 |
| 0.439 | 0.236 | 0.514 | −0.870 | 0.336 | 0.543 | 0.333 | −0.621 | 0.543 |
| 0.459 | −0.786 | 0.514 | −0.860 | 0.134 | 0.543 | 0.344 | 0.415 | 0.543 |
| 0.466 | 0.173 | 0.514 | −0.850 | 0.401 | 0.543 | 0.374 | −0.676 | 0.543 |
| 0.492 | 0.109 | 0.514 | −0.826 | 0.075 | 0.543 | 0.375 | 0.354 | 0.543 |
| 0.498 | −0.842 | 0.514 | −0.824 | 0.464 | 0.543 | 0.405 | 0.292 | 0.543 |
| 0.517 | 0.045 | 0.514 | −0.791 | 0.524 | 0.543 | 0.414 | 0.731 | 0.543 |
| 0.537 | −0.899 | 0.514 | −0.778 | 0.028 | 0.543 | 0.433 | 0.230 | 0.543 |
| 0.541 | −0.019 | 0.514 | −0.754 | 0.581 | 0.543 | 0.454 | −0.787 | 0.543 |
| 0.565 | −0.083 | 0.514 | −0.714 | 0.005 | 0.543 | 0.459 | 0.167 | 0.543 |
| 0.576 | −0.956 | 0.514 | −0.712 | 0.635 | 0.543 | 0.495 | 0.104 | 0.543 |
| 0.588 | −0.148 | 0.514 | −0.666 | 0.686 | 0.543 | 0.492 | −0.843 | 0.543 |
| 0.610 | −0.213 | 0.514 | −0.646 | 0.012 | 0.543 | 0.510 | 0.040 | 0.543 |
| 0.613 | −1.013 | 0.514 | −0.617 | 0.733 | 0.543 | 0.531 | −0.899 | 0.543 |
| 0.631 | −0.278 | 0.514 | −0.579 | 0.019 | 0.543 | 0.534 | −0.024 | 0.543 |
| 0.651 | −1.071 | 0.514 | −0.565 | 0.777 | 0.543 | 0.557 | −0.088 | 0.543 |
| 0.652 | −0.343 | 0.514 | −0.510 | 0.020 | 0.543 | 0.569 | −0.956 | 0.543 |
| 0.673 | −0.409 | 0.514 | −0.509 | 0.816 | 0.543 | 0.579 | −0.153 | 0.543 |
| 0.687 | −1.129 | 0.514 | −0.450 | 0.850 | 0.543 | 0.601 | −0.217 | 0.543 |
| 0.693 | −0.474 | 0.514 | −0.442 | 0.014 | 0.543 | 0.606 | −1.013 | 0.543 |
| 0.712 | −0.540 | 0.514 | −0.387 | 0.877 | 0.543 | 0.623 | −0.282 | 0.543 |
| 0.722 | −1.188 | 0.514 | −0.376 | −0.001 | 0.543 | 0.643 | −1.071 | 0.543 |
| 0.732 | −0.606 | 0.514 | −0.321 | 0.896 | 0.543 | 0.644 | −0.347 | 0.543 |
| 0.750 | −0.672 | 0.514 | −0.311 | −0.024 | 0.543 | 0.664 | −0.412 | 0.543 |
| 0.756 | −1.247 | 0.514 | −0.254 | 0.906 | 0.543 | 0.678 | −1.129 | 0.543 |
| 0.769 | −0.738 | 0.514 | −0.250 | −0.053 | 0.543 | 0.684 | −0.478 | 0.543 |
| 0.703 | −0.543 | 0.543 | −0.383 | 0.880 | 0.571 | 0.614 | −0.286 | 0.571 |
| 0.713 | −1.188 | 0.543 | −0.360 | 0.016 | 0.571 | 0.635 | −0.351 | 0.571 |
| 0.722 | −0.609 | 0.543 | −0.318 | 0.898 | 0.571 | 0.635 | −1.070 | 0.571 |
| 0.741 | −0.674 | 0.543 | −0.297 | −0.009 | 0.571 | 0.655 | −0.416 | 0.571 |
| 0.747 | −1.247 | 0.543 | −0.250 | 0.906 | 0.571 | 0.670 | 1.128 | 0.571 |
| 0.759 | −0.740 | 0.543 | −0.237 | −0.040 | 0.571 | 0.674 | −0.481 | 0.571 |
| 0.777 | −0.806 | 0.543 | −0.183 | 0.904 | 0.571 | 0.694 | −0.546 | 0.571 |
| 0.779 | −1.307 | 0.543 | −0.179 | −0.077 | 0.571 | 0.705 | −1.187 | 0.571 |
| 0.795 | −0.872 | 0.543 | −0.125 | −0.117 | 0.571 | 0.713 | −0.611 | 0.571 |
| 0.810 | −1.368 | 0.543 | −0.116 | 0.890 | 0.571 | 0.731 | −0.677 | 0.571 |
| 0.813 | −0.938 | 0.543 | −0.073 | −0.161 | 0.571 | 0.738 | −1.246 | 0.571 |
| 0.831 | −1.004 | 0.543 | −0.053 | 0.865 | 0.571 | 0.750 | −0.742 | 0.571 |
| 0.841 | −1.429 | 0.543 | −0.023 | −0.207 | 0.571 | 0.768 | −0.808 | 0.571 |
| 0.848 | −1.070 | 0.543 | 0.006 | 0.832 | 0.571 | 0.770 | −1.307 | 0.571 |
| 0.865 | −1.136 | 0.543 | 0.026 | −0.255 | 0.571 | 0.785 | −0.873 | 0.571 |
| 0.871 | −1.490 | 0.543 | 0.061 | 0.791 | 0.571 | 0.800 | −1.367 | 0.571 |
| 0.883 | −1.202 | 0.543 | 0.073 | −0.304 | 0.571 | 0.803 | −0.939 | 0.571 |
| 0.900 | −1.268 | 0.543 | 0.111 | 0.745 | 0.571 | 0.821 | −1.005 | 0.571 |
| 0.902 | −1.551 | 0.543 | 0.119 | −0.354 | 0.571 | 0.831 | −1.428 | 0.571 |
| 0.917 | −1.334 | 0.543 | 0.156 | 0.695 | 0.571 | 0.838 | −1.070 | 0.571 |
| 0.933 | −1.401 | 0.543 | 0.163 | −0.406 | 0.571 | 0.855 | −1.136 | 0.571 |
| 0.934 | −1.612 | 0.543 | 0.199 | 0.641 | 0.571 | 0.861 | −1.489 | 0.571 |
| 0.934 | −1.612 | 0.543 | 0.206 | −0.458 | 0.571 | 0.872 | −1.202 | 0.571 |
| 0.950 | −1.467 | 0.543 | 0.237 | 0.586 | 0.571 | 0.889 | −1.268 | 0.571 |
| 0.966 | −1.533 | 0.543 | 0.249 | −0.511 | 0.571 | 0.892 | −1.550 | 0.571 |
| 0.982 | −1.600 | 0.543 | 0.274 | 0.528 | 0.571 | 0.906 | −1.334 | 0.571 |
| −0.874 | 0.276 | 0.571 | 0.290 | −0.565 | 0.571 | 0.923 | −1.399 | 0.571 |
| −0.869 | 0.208 | 0.571 | 0.308 | 0.469 | 0.571 | 0.923 | −1.610 | 0.571 |
| −0.865 | 0.343 | 0.571 | 0.331 | −0.619 | 0.571 | 0.923 | −1.610 | 0.571 |
| −0.849 | 0.144 | 0.571 | 0.340 | 0.409 | 0.571 | 0.939 | −1.465 | 0.571 |
| −0.847 | 0.409 | 0.571 | 0.370 | 0.348 | 0.571 | 0.955 | −1.532 | 0.571 |
| −0.820 | 0.471 | 0.571 | 0.371 | −0.674 | 0.571 | 0.971 | −1.598 | 0.571 |
| −0.812 | 0.087 | 0.571 | 0.399 | 0.287 | 0.571 | −0.867 | 0.283 | 0.600 |
| −0.788 | 0.531 | 0.571 | 0.410 | −0.730 | 0.571 | −0.861 | 0.351 | 0.600 |
| −0.761 | 0.042 | 0.571 | 0.426 | 0.224 | 0.571 | −0.860 | 0.216 | 0.600 |
| −0.751 | 0.588 | 0.571 | 0.449 | −0.786 | 0.571 | −0.843 | 0.416 | 0.600 |
| −0.709 | 0.642 | 0.571 | 0.453 | 0.162 | 0.571 | −0.836 | 0.153 | 0.600 |
| −0.697 | 0.025 | 0.571 | 0.478 | 0.099 | 0.571 | −0.817 | 0.479 | 0.600 |
| −0.663 | 0.692 | 0.571 | 0.487 | −0.842 | 0.571 | −0.797 | 0.098 | 0.600 |

TABLE I-continued

| X | Y | Z' | X | Y | Z' | X | Y | Z' |
|---|---|---|---|---|---|---|---|---|
| −0.629 | 0.033 | 0.571 | 0.502 | 0.035 | 0.571 | −0.785 | 0.538 | 0.600 |
| −0.614 | 0.739 | 0.571 | 0.525 | −0.899 | 0.571 | −0.748 | 0.595 | 0.600 |
| −0.562 | 0.782 | 0.571 | 0.526 | −0.029 | 0.571 | −0.744 | 0.057 | 0.600 |
| −0.562 | 0.041 | 0.571 | 0.549 | −0.093 | 0.571 | −0.706 | 0.648 | 0.600 |
| −0.506 | 0.821 | 0.571 | 0.562 | −0.956 | 0.571 | −0.678 | 0.047 | 0.600 |
| −0.494 | 0.041 | 0.571 | 0.571 | −0.157 | 0.571 | −0.661 | 0.698 | 0.600 |
| −0.446 | 0.853 | 0.571 | 0.593 | −0.221 | 0.571 | −0.612 | 0.745 | 0.600 |
| −0.426 | 0.033 | 0.571 | 0.599 | −1.013 | 0.571 | −0.611 | 0.057 | 0.600 |
| −0.559 | 0.787 | 0.600 | 0.520 | −0.897 | 0.600 | −0.725 | 0.075 | 0.629 |
| −0.543 | 0.063 | 0.600 | 0.541 | −0.097 | 0.600 | −0.704 | 0.655 | 0.629 |
| −0.503 | 0.825 | 0.600 | 0.556 | −0.954 | 0.600 | −0.658 | 0.072 | 0.629 |
| −0.476 | 0.061 | 0.600 | 0.563 | −0.161 | 0.600 | −0.658 | 0.704 | 0.629 |
| −0.443 | 0.857 | 0.600 | 0.584 | −0.225 | 0.600 | −0.609 | 0.750 | 0.629 |
| −0.409 | 0.051 | 0.600 | 0.592 | −1.011 | 0.600 | −0.591 | 0.081 | 0.629 |
| −0.380 | 0.882 | 0.600 | 0.605 | −0.289 | 0.600 | −0.556 | 0.792 | 0.629 |
| −0.344 | 0.032 | 0.600 | 0.626 | −0.354 | 0.600 | −0.524 | 0.086 | 0.629 |
| −0.315 | 0.899 | 0.600 | 0.628 | −1.069 | 0.600 | −0.500 | 0.828 | 0.629 |
| −0.282 | 0.005 | 0.600 | 0.646 | −0.418 | 0.600 | −0.457 | 0.082 | 0.629 |
| −0.248 | 0.906 | 0.600 | 0.662 | −1.127 | 0.600 | −0.440 | 0.859 | 0.629 |
| −0.223 | −0.028 | 0.600 | 0.665 | −0.483 | 0.600 | −0.391 | 0.070 | 0.629 |
| −0.180 | 0.902 | 0.600 | 0.684 | −0.548 | 0.600 | −0.377 | 0.883 | 0.629 |
| −0.167 | −0.066 | 0.600 | 0.696 | −1.186 | 0.600 | −0.327 | 0.048 | 0.629 |
| −0.114 | −0.108 | 0.600 | 0.703 | −0.613 | 0.600 | −0.311 | 0.899 | 0.629 |
| −0.114 | 0.887 | 0.600 | 0.722 | −0.678 | 0.600 | −0.266 | 0.019 | 0.629 |
| −0.063 | −0.153 | 0.600 | 0.729 | −1.245 | 0.600 | −0.244 | 0.905 | 0.629 |
| −0.051 | 0.862 | 0.600 | 0.740 | −0.744 | 0.600 | −0.209 | −0.016 | 0.629 |
| −0.015 | −0.200 | 0.600 | 0.758 | −0.809 | 0.600 | −0.177 | 0.900 | 0.629 |
| 0.007 | 0.828 | 0.600 | 0.760 | −1.305 | 0.600 | −0.155 | −0.056 | 0.629 |
| 0.032 | −0.249 | 0.600 | 0.775 | −0.874 | 0.600 | −0.112 | 0.885 | 0.629 |
| 0.061 | 0.787 | 0.600 | 0.791 | −1.366 | 0.600 | −0.103 | −0.099 | 0.629 |
| 0.078 | −0.299 | 0.600 | 0.793 | −0.939 | 0.600 | −0.054 | −0.145 | 0.629 |
| 0.110 | 0.740 | 0.600 | 0.810 | −1.005 | 0.600 | −0.050 | 0.858 | 0.629 |
| 0.122 | −0.350 | 0.600 | 0.821 | −1.426 | 0.600 | −0.007 | −0.193 | 0.629 |
| 0.155 | 0.689 | 0.600 | 0.828 | −1.070 | 0.600 | 0.008 | 0.823 | 0.629 |
| 0.166 | −0.402 | 0.600 | 0.845 | −1.136 | 0.600 | 0.039 | −0.243 | 0.629 |
| 0.196 | 0.636 | 0.600 | 0.851 | −1.487 | 0.600 | 0.060 | 0.782 | 0.629 |
| 0.208 | −0.455 | 0.600 | 0.862 | −1.201 | 0.600 | 0.083 | −0.294 | 0.629 |
| 0.234 | 0.580 | 0.600 | 0.879 | −1.267 | 0.600 | 0.109 | 0.735 | 0.629 |
| 0.249 | −0.508 | 0.600 | 0.881 | −1.547 | 0.600 | 0.127 | −0.345 | 0.629 |
| 0.270 | 0.522 | 0.600 | 0.895 | −1.332 | 0.600 | 0.153 | 0.684 | 0.629 |
| 0.290 | −0.562 | 0.600 | 0.912 | −1.398 | 0.600 | 0.169 | −0.398 | 0.629 |
| 0.303 | 0.464 | 0.600 | 0.912 | −1.607 | 0.600 | 0.193 | 0.630 | 0.629 |
| 0.330 | −0.617 | 0.600 | 0.912 | −1.607 | 0.600 | 0.210 | −0.451 | 0.629 |
| 0.334 | 0.404 | 0.600 | 0.928 | −1.464 | 0.600 | 0.231 | 0.574 | 0.629 |
| 0.364 | 0.343 | 0.600 | 0.944 | −1.530 | 0.600 | 0.250 | −0.505 | 0.629 |
| 0.369 | −0.672 | 0.600 | 0.960 | −1.595 | 0.600 | 0.266 | 0.517 | 0.629 |
| 0.393 | 0.281 | 0.600 | −0.860 | 0.291 | 0.629 | 0.290 | −0.560 | 0.629 |
| 0.407 | −0.728 | 0.600 | −0.855 | 0.358 | 0.629 | 0.299 | 0.458 | 0.629 |
| 0.420 | 0.219 | 0.600 | −0.850 | 0.225 | 0.629 | 0.329 | −0.615 | 0.629 |
| 0.445 | −0.784 | 0.600 | −0.839 | 0.423 | 0.629 | 0.330 | 0.398 | 0.629 |
| 0.446 | 0.157 | 0.600 | −0.823 | 0.163 | 0.629 | 0.359 | 0.337 | 0.629 |
| 0.471 | 0.094 | 0.600 | −0.814 | 0.486 | 0.629 | 0.367 | −0.670 | 0.629 |
| 0.483 | −0.841 | 0.600 | −0.782 | 0.545 | 0.629 | 0.387 | 0.276 | 0.629 |
| 0.495 | 0.031 | 0.600 | −0.781 | 0.111 | 0.629 | 0.405 | −0.726 | 0.629 |
| 0.518 | −0.033 | 0.600 | −0.745 | 0.602 | 0.629 | 0.413 | 0.214 | 0.629 |
| 0.439 | 0.152 | 0.629 | −0.835 | 0.431 | 0.657 | 0.328 | −0.612 | 0.657 |
| 0.442 | −0.782 | 0.629 | −0.811 | 0.494 | 0.657 | 0.353 | 0.331 | 0.657 |
| 0.464 | 0.089 | 0.629 | −0.809 | 0.174 | 0.657 | 0.365 | −0.668 | 0.657 |
| 0.478 | −0.839 | 0.629 | −0.780 | 0.553 | 0.657 | 0.381 | 0.270 | 0.657 |
| 0.487 | 0.026 | 0.629 | −0.764 | 0.124 | 0.657 | 0.402 | −0.724 | 0.657 |
| 0.511 | −0.037 | 0.629 | −0.743 | 0.609 | 0.657 | 0.407 | 0.209 | 0.657 |
| 0.515 | −0.896 | 0.629 | −0.704 | 0.096 | 0.657 | 0.432 | 0.146 | 0.657 |
| 0.533 | −0.101 | 0.629 | −0.701 | 0.661 | 0.657 | 0.438 | −0.780 | 0.657 |
| 0.550 | −0.953 | 0.629 | −0.655 | 0.710 | 0.657 | 0.457 | 0.084 | 0.657 |
| 0.555 | −0.165 | 0.629 | −0.638 | 0.098 | 0.657 | 0.474 | −0.837 | 0.657 |
| 0.576 | −0.229 | 0.629 | −0.606 | 0.755 | 0.657 | 0.480 | 0.021 | 0.657 |
| 0.586 | −1.010 | 0.629 | −0.571 | 0.107 | 0.657 | 0.503 | −0.042 | 0.657 |
| 0.597 | −0.293 | 0.629 | −0.553 | 0.796 | 0.657 | 0.510 | −0.894 | 0.657 |
| 0.617 | −0.357 | 0.629 | −0.504 | 0.109 | 0.657 | 0.525 | −0.105 | 0.657 |
| 0.621 | −1.068 | 0.629 | −0.496 | 0.832 | 0.657 | 0.545 | −0.951 | 0.657 |
| 0.637 | −0.421 | 0.629 | −0.438 | 0.103 | 0.657 | 0.547 | −0.169 | 0.657 |
| 0.655 | −1.126 | 0.629 | −0.436 | 0.962 | 0.657 | 0.568 | −0.232 | 0.657 |
| 0.656 | −0.486 | 0.629 | −0.373 | 0.885 | 0.657 | 0.580 | −1.008 | 0.657 |
| 0.675 | −0.551 | 0.629 | −0.372 | 0.088 | 0.657 | 0.588 | −0.296 | 0.657 |
| 0.688 | −1.184 | 0.629 | −0.310 | 0.063 | 0.657 | 0.608 | −0.360 | 0.657 |
| 0.694 | −0.615 | 0.629 | −0.308 | 0.900 | 0.657 | 0.614 | −1.066 | 0.657 |
| 0.712 | −0.680 | 0.629 | −0.251 | 0.032 | 0.657 | 0.628 | −0.424 | 0.657 |

TABLE I-continued

| X | Y | Z' | X | Y | Z' | X | Y | Z' |
|---|---|---|---|---|---|---|---|---|
| 0.720 | −1.243 | 0.629 | −0.241 | 0.905 | 0.657 | 0.647 | −0.488 | 0.657 |
| 0.730 | −0.745 | 0.629 | −0.195 | −0.005 | 0.657 | 0.647 | −1.124 | 0.657 |
| 0.748 | −0.810 | 0.629 | −0.174 | 0.898 | 0.657 | 0.666 | −0.553 | 0.657 |
| 0.751 | −1.303 | 0.629 | −0.142 | −0.047 | 0.657 | 0.680 | −1.182 | 0.657 |
| 0.765 | −0.875 | 0.629 | −0.110 | 0.881 | 0.657 | 0.684 | −0.617 | 0.657 |
| 0.781 | −1.364 | 0.629 | −0.092 | −0.091 | 0.657 | 0.702 | −0.682 | 0.657 |
| 0.783 | −0.940 | 0.629 | −0.048 | 0.854 | 0.657 | 0.711 | −1.241 | 0.657 |
| 0.800 | −1.005 | 0.629 | −0.044 | −0.138 | 0.657 | 0.720 | −0.746 | 0.657 |
| 0.810 | −1.424 | 0.629 | 0.001 | −0.187 | 0.657 | 0.738 | −0.811 | 0.657 |
| 0.817 | −1.070 | 0.629 | 0.008 | 0.819 | 0.657 | 0.742 | −1.301 | 0.657 |
| 0.834 | −1.135 | 0.629 | 0.046 | −0.237 | 0.657 | 0.756 | −0.876 | 0.657 |
| 0.840 | −1.485 | 0.629 | 0.060 | 0.776 | 0.657 | 0.771 | −1.361 | 0.657 |
| 0.851 | −1.201 | 0.629 | 0.089 | −0.289 | 0.657 | 0.773 | −0.940 | 0.657 |
| 0.868 | −1.266 | 0.629 | 0.108 | 0.729 | 0.657 | 0.790 | −1.005 | 0.657 |
| 0.870 | −1.545 | 0.629 | 0.131 | −0.341 | 0.657 | 0.800 | −1.422 | 0.657 |
| 0.885 | −1.331 | 0.629 | 0.151 | 0.678 | 0.657 | 0.807 | −1.070 | 0.657 |
| 0.901 | −1.396 | 0.629 | 0.172 | −0.394 | 0.657 | 0.824 | −1.135 | 0.657 |
| 0.901 | −1.605 | 0.629 | 0.191 | 0.624 | 0.657 | 0.830 | −1.482 | 0.657 |
| 0.901 | −1.605 | 0.629 | 0.212 | −0.448 | 0.657 | 0.841 | −1.200 | 0.657 |
| 0.917 | −1.462 | 0.629 | 0.228 | 0.568 | 0.657 | 0.857 | −1.265 | 0.657 |
| 0.933 | −1.527 | 0.629 | 0.251 | −0.502 | 0.657 | 0.859 | −1.542 | 0.657 |
| 0.949 | −1.593 | 0.629 | 0.262 | 0.511 | 0.657 | 0.874 | −1.330 | 0.657 |
| −0.853 | 0.299 | 0.657 | 0.290 | −0.557 | 0.657 | 0.890 | −1.602 | 0.657 |
| −0.850 | 0.366 | 0.657 | 0.294 | 0.452 | 0.657 | 0.890 | −1.602 | 0.657 |
| −0.839 | 0.234 | 0.657 | 0.325 | 0.392 | 0.657 | 0.890 | −1.395 | 0.657 |
| 0.906 | −1.460 | 0.657 | 0.225 | 0.563 | 0.686 | 0.847 | −1.263 | 0.686 |
| 0.922 | −1.525 | 0.657 | 0.253 | −0.498 | 0.686 | 0.848 | −1.539 | 0.686 |
| 0.938 | −1.590 | 0.657 | 0.258 | 0.505 | 0.686 | 0.863 | −1.328 | 0.686 |
| −0.845 | 0.308 | 0.686 | 0.290 | 0.446 | 0.686 | 0.879 | −1.598 | 0.686 |
| −0.845 | 0.374 | 0.686 | 0.290 | −0.553 | 0.686 | 0.879 | −1.598 | 0.686 |
| −0.832 | 0.440 | 0.686 | 0.320 | 0.387 | 0.686 | 0.880 | −1.392 | 0.686 |
| −0.828 | 0.243 | 0.686 | 0.327 | −0.609 | 0.686 | 0.896 | −1.457 | 0.686 |
| −0.808 | 0.502 | 0.686 | 0.348 | 0.326 | 0.686 | 0.911 | −1.522 | 0.686 |
| −0.794 | 0.186 | 0.686 | 0.364 | −0.665 | 0.686 | 0.927 | −1.587 | 0.686 |
| −0.777 | 0.561 | 0.686 | 0.375 | 0.265 | 0.686 | −0.840 | 0.383 | 0.714 |
| −0.746 | 0.140 | 0.686 | 0.400 | −0.721 | 0.686 | −0.837 | 0.317 | 0.714 |
| −0.740 | 0.617 | 0.686 | 0.401 | 0.204 | 0.686 | −0.829 | 0.449 | 0.714 |
| −0.699 | 0.669 | 0.686 | 0.426 | 0.142 | 0.686 | −0.816 | 0.254 | 0.714 |
| −0.683 | 0.120 | 0.686 | 0.435 | −0.777 | 0.686 | −0.807 | 0.511 | 0.714 |
| −0.653 | 0.717 | 0.686 | 0.450 | 0.080 | 0.686 | −0.779 | 0.199 | 0.714 |
| −0.617 | 0.126 | 0.686 | 0.470 | −0.834 | 0.686 | −0.776 | 0.570 | 0.714 |
| −0.603 | 0.761 | 0.686 | 0.473 | 0.017 | 0.686 | −0.739 | 0.625 | 0.714 |
| −0.551 | 0.133 | 0.686 | 0.495 | −0.046 | 0.686 | −0.727 | 0.159 | 0.714 |
| −0.550 | 0.801 | 0.686 | 0.505 | −0.891 | 0.686 | −0.697 | 0.677 | 0.714 |
| −0.493 | 0.837 | 0.686 | 0.517 | −0.109 | 0.686 | −0.663 | 0.147 | 0.714 |
| −0.484 | 0.133 | 0.686 | 0.539 | −0.172 | 0.686 | −0.651 | 0.724 | 0.714 |
| −0.433 | 0.866 | 0.686 | 0.539 | −0.948 | 0.686 | −0.601 | 0.768 | 0.714 |
| −0.418 | 0.124 | 0.686 | 0.559 | −0.235 | 0.686 | −0.597 | 0.155 | 0.714 |
| −0.370 | 0.887 | 0.686 | 0.573 | −1.006 | 0.686 | −0.548 | 0.807 | 0.714 |
| −0.354 | 0.105 | 0.686 | 0.580 | −0.299 | 0.686 | −0.530 | 0.160 | 0.714 |
| −0.305 | 0.901 | 0.686 | 0.599 | −0.363 | 0.686 | −0.491 | 0.842 | 0.714 |
| −0.293 | 0.078 | 0.686 | 0.607 | −1.063 | 0.686 | −0.464 | 0.157 | 0.714 |
| −0.238 | 0.904 | 0.686 | 0.619 | −0.427 | 0.686 | −0.431 | 0.870 | 0.714 |
| −0.236 | 0.044 | 0.686 | 0.638 | −0.490 | 0.686 | −0.399 | 0.145 | 0.714 |
| −0.181 | 0.006 | 0.686 | 0.640 | −1.121 | 0.686 | −0.368 | 0.891 | 0.714 |
| −0.172 | 0.897 | 0.686 | 0.657 | −0.555 | 0.686 | −0.336 | 0.123 | 0.714 |
| −0.130 | −0.037 | 0.686 | 0.672 | −1.180 | 0.686 | −0.302 | 0.903 | 0.714 |
| −0.108 | 0.879 | 0.686 | 0.675 | −0.619 | 0.686 | −0.277 | 0.093 | 0.714 |
| −0.082 | −0.083 | 0.686 | 0.693 | −0.683 | 0.686 | −0.236 | 0.905 | 0.714 |
| −0.047 | 0.851 | 0.686 | 0.703 | −1.239 | 0.686 | −0.221 | 0.057 | 0.714 |
| −0.035 | −0.131 | 0.686 | 0.711 | −0.747 | 0.686 | −0.170 | 0.896 | 0.714 |
| 0.009 | 0.814 | 0.686 | 0.728 | −0.812 | 0.686 | −0.168 | 0.017 | 0.714 |
| 0.009 | −0.181 | 0.686 | 0.732 | −1.299 | 0.686 | −0.119 | −0.027 | 0.714 |
| 0.052 | −0.232 | 0.686 | 0.746 | −0.876 | 0.686 | −0.107 | 0.877 | 0.714 |
| 0.060 | 0.771 | 0.686 | 0.761 | −1.359 | 0.636 | −0.071 | −0.074 | 0.714 |
| 0.094 | −0.284 | 0.686 | 0.763 | −0.940 | 0.686 | −0.047 | 0.848 | 0.714 |
| 0.106 | 0.724 | 0.686 | 0.780 | −1.005 | 0.686 | −0.026 | −0.123 | 0.714 |
| 0.135 | −0.336 | 0.686 | 0.790 | −1.419 | 0.686 | 0.008 | 0.811 | 0.714 |
| 0.149 | 0.672 | 0.686 | 0.797 | −1.069 | 0.686 | 0.017 | −0.173 | 0.714 |
| 0.175 | −0.390 | 0.686 | 0.814 | −1.134 | 0.686 | 0.058 | 0.768 | 0.714 |
| 0.188 | 0.619 | 0.686 | 0.819 | −1.479 | 0.686 | 0.059 | −0.225 | 0.714 |
| 0.214 | −0.444 | 0.686 | 0.830 | −1.199 | 0.696 | 0.100 | −0.277 | 0.714 |
| 0.104 | 0.720 | 0.714 | 0.770 | −1.004 | 0.714 | −0.018 | −0.114 | 0.743 |
| 0.140 | −0.330 | 0.714 | 0.780 | −1.416 | 0.714 | 0.006 | 0.810 | 0.743 |
| 0.146 | 0.668 | 0.714 | 0.786 | −1.068 | 0.714 | 0.024 | −0.165 | 0.743 |
| 0.179 | −0.384 | 0.714 | 0.803 | −1.133 | 0.714 | 0.056 | 0.766 | 0.743 |
| 0.185 | 0.614 | 0.714 | 0.808 | −1.476 | 0.714 | 0.065 | −0.217 | 0.743 |

TABLE I-continued

| X | Y | Z' | X | Y | Z' | X | Y | Z' |
|---|---|---|---|---|---|---|---|---|
| 0.217 | −0.438 | 0.714 | 0.820 | −1.197 | 0.714 | 0.101 | 0.717 | 0.743 |
| 0.220 | 0.558 | 0.714 | 0.836 | −1.261 | 0.714 | 0.105 | −0.269 | 0.743 |
| 0.254 | 0.501 | 0.714 | 0.837 | −1.535 | 0.714 | 0.142 | 0.666 | 0.743 |
| 0.254 | −0.493 | 0.714 | 0.853 | −1.326 | 0.714 | 0.144 | −0.323 | 0.743 |
| 0.285 | 0.442 | 0.714 | 0.868 | −1.594 | 0.714 | 0.180 | 0.612 | 0.743 |
| 0.291 | −0.549 | 0.714 | 0.868 | −1.594 | 0.714 | 0.182 | −0.377 | 0.743 |
| 0.314 | 0.382 | 0.714 | 0.869 | −1.390 | 0.714 | 0.215 | 0.556 | 0.743 |
| 0.327 | −0.604 | 0.714 | 0.885 | −1.454 | 0.714 | 0.219 | −0.432 | 0.743 |
| 0.342 | 0.322 | 0.714 | 0.900 | −1.519 | 0.714 | 0.248 | 0.498 | 0.743 |
| 0.362 | −0.661 | 0.714 | 0.916 | −1.583 | 0.714 | 0.256 | −0.487 | 0.743 |
| 0.368 | 0.261 | 0.714 | −0.836 | 0.393 | 0.743 | 0.279 | 0.439 | 0.743 |
| 0.394 | 0.200 | 0.714 | −0.830 | 0.327 | 0.743 | 0.291 | −0.543 | 0.743 |
| 0.398 | −0.717 | 0.714 | −0.827 | 0.458 | 0.743 | 0.308 | 0.380 | 0.743 |
| 0.419 | 0.138 | 0.714 | −0.806 | 0.521 | 0.743 | 0.327 | −0.599 | 0.743 |
| 0.432 | −0.774 | 0.714 | −0.805 | 0.266 | 0.743 | 0.335 | 0.320 | 0.743 |
| 0.442 | 0.076 | 0.714 | −0.776 | 0.580 | 0.743 | 0.361 | −0.655 | 0.743 |
| 0.465 | 0.014 | 0.714 | −0.764 | 0.214 | 0.743 | 0.361 | 0.259 | 0.743 |
| 0.466 | −0.831 | 0.714 | −0.740 | 0.635 | 0.743 | 0.387 | 0.198 | 0.743 |
| 0.487 | −0.049 | 0.714 | −0.703 | 0.180 | 0.743 | 0.395 | −0.712 | 0.743 |
| 0.500 | −0.888 | 0.714 | −0.698 | 0.686 | 0.743 | 0.411 | 0.136 | 0.743 |
| 0.509 | −0.112 | 0.714 | −0.651 | 0.733 | 0.743 | 0.429 | −0.769 | 0.743 |
| 0.530 | −0.175 | 0.714 | −0.642 | 0.177 | 0.743 | 0.434 | 0.074 | 0.743 |
| 0.534 | −0.945 | 0.714 | −0.601 | 0.776 | 0.743 | 0.457 | 0.012 | 0.743 |
| 0.551 | −0.238 | 0.714 | −0.577 | 0.184 | 0.743 | 0.463 | −0.826 | 0.743 |
| 0.567 | −1.003 | 0.714 | −0.547 | 0.814 | 0.743 | 0.479 | −0.050 | 0.743 |
| 0.571 | −0.301 | 0.714 | −0.511 | 0.187 | 0.743 | 0.496 | −0.883 | 0.743 |
| 0.590 | −0.364 | 0.714 | −0.490 | 0.848 | 0.743 | 0.500 | −0.113 | 0.743 |
| 0.600 | −1.060 | 0.714 | −0.445 | 0.181 | 0.743 | 0.521 | −0.176 | 0.743 |
| 0.610 | −0.428 | 0.714 | −0.430 | 0.375 | 0.743 | 0.528 | −0.941 | 0.743 |
| 0.629 | −0.492 | 0.714 | −0.380 | 0.166 | 0.743 | 0.542 | −0.239 | 0.743 |
| 0.632 | −1.118 | 0.714 | −0.367 | 0.895 | 0.743 | 0.561 | −0.998 | 0.743 |
| 0.647 | −0.556 | 0.714 | −0.319 | 0.141 | 0.743 | 0.562 | −0.302 | 0.743 |
| 0.663 | −1.177 | 0.714 | −0.302 | 0.906 | 0.743 | 0.581 | −0.365 | 0.743 |
| 0.665 | −0.619 | 0.714 | −0.262 | 0.109 | 0.743 | 0.593 | −1.056 | 0.743 |
| 0.683 | −0.683 | 0.714 | −0.235 | 0.908 | 0.743 | 0.600 | −0.428 | 0.743 |
| 0.694 | −1.236 | 0.714 | −0.207 | 0.071 | 0.743 | 0.619 | −0.492 | 0.743 |
| 0.701 | −0.747 | 0.714 | −0.170 | 0.898 | 0.743 | 0.624 | −1.114 | 0.743 |
| 0.718 | −0.811 | 0.714 | −0.156 | 0.029 | 0.743 | 0.637 | −0.555 | 0.743 |
| 0.723 | −1.296 | 0.714 | −0.108 | −0.016 | 0.743 | 0.655 | −1.173 | 0.743 |
| 0.735 | −0.876 | 0.714 | −0.107 | 0.877 | 0.743 | 0.655 | −0.619 | 0.743 |
| 0.751 | −1.356 | 0.714 | −0.062 | −0.064 | 0.743 | 0.673 | −0.683 | 0.743 |
| 0.753 | −0.940 | 0.714 | −0.048 | 0.847 | 0.743 | 0.684 | −1.232 | 0.743 |
| 0.691 | −0.747 | 0.743 | −0.170 | 0.899 | 0.771 | 0.616 | −1.110 | 0.771 |
| 0.708 | −0.811 | 0.743 | −0.144 | 0.041 | 0.771 | 0.627 | −0.555 | 0.771 |
| 0.713 | −1.292 | 0.743 | −0.108 | 0.878 | 0.771 | 0.645 | −0.619 | 0.771 |
| 0.725 | −0.874 | 0.743 | −0.097 | −0.006 | 0.771 | 0.646 | −1.169 | 0.771 |
| 0.741 | −1.352 | 0.743 | −0.053 | −0.054 | 0.771 | 0.663 | −0.682 | 0.771 |
| 0.742 | −0.938 | 0.743 | −0.050 | 0.847 | 0.771 | 0.675 | −1.228 | 0.771 |
| 0.759 | −1.002 | 0.743 | −0.010 | −0.104 | 0.771 | 0.680 | −0.746 | 0.771 |
| 0.769 | −1.412 | 0.743 | 0.004 | 0.303 | 0.771 | 0.698 | −0.809 | 0.771 |
| 0.776 | −1.066 | 0.743 | 0.031 | −0.156 | 0.771 | 0.703 | −1.288 | 0.771 |
| 0.792 | −1.130 | 0.743 | 0.053 | 0.764 | 0.771 | 0.715 | −0.873 | 0.771 |
| 0.797 | −1.472 | 0.743 | 0.071 | −0.208 | 0.771 | 0.730 | −1.348 | 0.771 |
| 0.809 | −1.194 | 0.743 | 0.097 | 0.715 | 0.771 | 0.732 | −0.937 | 0.771 |
| 0.825 | −1.259 | 0.743 | 0.110 | −0.261 | 0.771 | 0.748 | −1.000 | 0.771 |
| 0.826 | −1.531 | 0.743 | 0.138 | 0.663 | 0.771 | 0.758 | −1.408 | 0.771 |
| 0.842 | −1.323 | 0.743 | 0.148 | −0.315 | 0.771 | 0.765 | −1.064 | 0.771 |
| 0.856 | −1.590 | 0.743 | 0.175 | 0.609 | 0.771 | 0.782 | −1.128 | 0.771 |
| 0.856 | −1.590 | 0.743 | 0.185 | −0.370 | 0.771 | 0.786 | −1.468 | 0.771 |
| 0.858 | −1.387 | 0.743 | 0.210 | 0.553 | 0.771 | 0.798 | −1.192 | 0.771 |
| 0.874 | −1.451 | 0.743 | 0.222 | −0.425 | 0.771 | 0.814 | −1.256 | 0.771 |
| 0.889 | −1.515 | 0.743 | 0.242 | 0.496 | 0.771 | 0.815 | −1.527 | 0.771 |
| 0.904 | −1.580 | 0.743 | 0.257 | −0.480 | 0.771 | 0.831 | −1.320 | 0.771 |
| −0.832 | 0.403 | 0.771 | 0.273 | 0.437 | 0.771 | 0.845 | −1.585 | 0.771 |
| −0.826 | 0.468 | 0.771 | 0.292 | −0.536 | 0.771 | 0.845 | −1.585 | 0.771 |
| −0.821 | 0.338 | 0.771 | 0.301 | 0.378 | 0.771 | 0.847 | −1.384 | 0.771 |
| −0.807 | 0.531 | 0.771 | 0.327 | −0.592 | 0.771 | 0.863 | −1.448 | 0.771 |
| −0.793 | 0.279 | 0.771 | 0.328 | 0.318 | 0.771 | 0.878 | −1.512 | 0.771 |
| −0.777 | 0.590 | 0.771 | 0.354 | 0.257 | 0.771 | 0.893 | −1.576 | 0.771 |
| −0.748 | 0.230 | 0.771 | 0.360 | −0.649 | 0.771 | −0.825 | 0.414 | 0.800 |
| −0.740 | 0.645 | 0.771 | 0.379 | 0.196 | 0.771 | −0.822 | 0.479 | 0.800 |
| −0.698 | 0.696 | 0.771 | 0.394 | −0.706 | 0.771 | −0.810 | 0.350 | 0.800 |
| −0.688 | 0.206 | 0.771 | 0.403 | 0.135 | 0.771 | −0.805 | 0.542 | 0.800 |
| −0.652 | 0.742 | 0.771 | 0.426 | −0.763 | 0.771 | −0.779 | 0.293 | 0.800 |
| −0.622 | 0.208 | 0.771 | 0.426 | 0.073 | 0.771 | −0.776 | 0.601 | 0.800 |
| −0.601 | 0.784 | 0.771 | 0.449 | 0.011 | 0.771 | −0.739 | 0.656 | 0.800 |
| −0.557 | 0.214 | 0.771 | 0.459 | −0.821 | 0.771 | −0.730 | 0.250 | 0.800 |

TABLE I-continued

| X | Y | Z' | X | Y | Z' | X | Y | Z' |
|---|---|---|---|---|---|---|---|---|
| −0.547 | 0.822 | 0.771 | 0.471 | −0.052 | 0.771 | −0.697 | 0.706 | 0.800 |
| −0.491 | 0.214 | 0.771 | 0.491 | −0.878 | 0.771 | −0.666 | 0.236 | 0.800 |
| −0.490 | 0.854 | 0.771 | 0.492 | −0.114 | 0.771 | −0.650 | 0.751 | 0.800 |
| −0.429 | 0.881 | 0.771 | 0.512 | −0.177 | 0.771 | −0.601 | 0.240 | 0.800 |
| −0.425 | 0.205 | 0.771 | 0.523 | −0.936 | 0.771 | −0.599 | 0.793 | 0.800 |
| −0.366 | 0.899 | 0.771 | 0.533 | −0.239 | 0.771 | −0.544 | 0.829 | 0.800 |
| −0.362 | 0.186 | 0.771 | 0.552 | −0.302 | 0.771 | −0.535 | 0.244 | 0.800 |
| −0.303 | 0.158 | 0.771 | 0.554 | −0.994 | 0.771 | −0.487 | 0.861 | 0.800 |
| −0.301 | 0.910 | 0.771 | 0.572 | −0.365 | 0.771 | −0.470 | 0.240 | 0.800 |
| −0.247 | 0.124 | 0.771 | 0.586 | −1.052 | 0.771 | −0.426 | 0.886 | 0.800 |
| −0.235 | 0.910 | 0.771 | 0.591 | −0.428 | 0.771 | −0.406 | 0.226 | 0.800 |
| −0.194 | 0.084 | 0.771 | 0.609 | −0.492 | 0.771 | −0.363 | 0.903 | 0.800 |
| −0.344 | 0.203 | 0.800 | 0.544 | −0.304 | 0.800 | −0.513 | 0.270 | 0.829 |
| −0.298 | 0.912 | 0.800 | 0.549 | −0.990 | 0.800 | −0.480 | 0.866 | 0.829 |
| −0.286 | 0.172 | 0.800 | 0.563 | −0.367 | 0.800 | −0.448 | 0.261 | 0.829 |
| −0.232 | 0.911 | 0.800 | 0.579 | −1.048 | 0.800 | −0.419 | 0.890 | 0.829 |
| −0.232 | 0.135 | 0.800 | 0.582 | −0.430 | 0.800 | −0.385 | 0.243 | 0.829 |
| −0.181 | 0.094 | 0.800 | 0.600 | −0.493 | 0.800 | −0.356 | 0.905 | 0.829 |
| −0.168 | 0.899 | 0.800 | 0.609 | −1.107 | 0.800 | −0.326 | 0.215 | 0.829 |
| −0.133 | 0.050 | 0.800 | 0.618 | −0.556 | 0.800 | −0.291 | 0.912 | 0.829 |
| −0.106 | 0.876 | 0.800 | 0.636 | −0.619 | 0.800 | −0.271 | 0.181 | 0.829 |
| −0.087 | 0.002 | 0.800 | 0.638 | −1.165 | 0.800 | −0.226 | 0.910 | 0.829 |
| −0.049 | 0.844 | 0.800 | 0.653 | −0.682 | 0.800 | −0.218 | 0.142 | 0.829 |
| −0.044 | −0.047 | 0.800 | 0.666 | −1.225 | 0.800 | −0.169 | 0.099 | 0.829 |
| −0.002 | −0.098 | 0.800 | 0.671 | −0.745 | 0.800 | −0.162 | 0.896 | 0.829 |
| 0.004 | 0.805 | 0.800 | 0.688 | −0.809 | 0.800 | −0.123 | 0.054 | 0.829 |
| 0.038 | −0.149 | 0.800 | 0.694 | −1.284 | 0.800 | −0.102 | 0.872 | 0.829 |
| 0.052 | 0.761 | 0.800 | 0.705 | −0.872 | 0.800 | −0.078 | 0.006 | 0.829 |
| 0.077 | −0.202 | 0.800 | 0.721 | −1.344 | 0.800 | −0.045 | 0.839 | 0.829 |
| 0.095 | 0.711 | 0.800 | 0.722 | −0.936 | 0.800 | −0.036 | −0.044 | 0.829 |
| 0.115 | −0.256 | 0.800 | 0.738 | −0.999 | 0.800 | 0.005 | −0.095 | 0.829 |
| 0.135 | 0.659 | 0.800 | 0.748 | −1.404 | 0.800 | 0.006 | 0.799 | 0.829 |
| 0.152 | −0.310 | 0.800 | 0.755 | −1.063 | 0.800 | 0.044 | −0.147 | 0.829 |
| 0.172 | 0.605 | 0.800 | 0.771 | −1.126 | 0.800 | 0.053 | 0.754 | 0.829 |
| 0.189 | −0.364 | 0.800 | 0.775 | −1.464 | 0.800 | 0.082 | −0.200 | 0.829 |
| 0.206 | 0.549 | 0.800 | 0.788 | −1.190 | 0.800 | 0.096 | 0.705 | 0.829 |
| 0.224 | −0.420 | 0.800 | 0.804 | −1.523 | 0.800 | 0.119 | −0.254 | 0.829 |
| 0.238 | 0.492 | 0.800 | 0.804 | −1.253 | 0.800 | 0.134 | 0.652 | 0.829 |
| 0.259 | −0.475 | 0.800 | 0.820 | −1.317 | 0.800 | 0.156 | −0.308 | 0.829 |
| 0.268 | 0.433 | 0.800 | 0.834 | −1.581 | 0.800 | 0.170 | 0.598 | 0.829 |
| 0.293 | −0.531 | 0.800 | 0.834 | −1.581 | 0.800 | 0.191 | −0.363 | 0.829 |
| 0.296 | 0.374 | 0.800 | 0.836 | −1.380 | 0.800 | 0.204 | 0.542 | 0.829 |
| 0.323 | 0.314 | 0.800 | 0.852 | −1.444 | 0.800 | 0.226 | −0.418 | 0.829 |
| 0.326 | −0.588 | 0.800 | 0.868 | −1.508 | 0.800 | 0.235 | 0.485 | 0.829 |
| 0.348 | 0.253 | 0.800 | 0.882 | −1.572 | 0.800 | 0.260 | −0.473 | 0.829 |
| 0.359 | −0.645 | 0.800 | −0.815 | 0.426 | 0.829 | 0.264 | 0.426 | 0.829 |
| 0.373 | 0.193 | 0.800 | −0.815 | 0.491 | 0.829 | 0.292 | 0.367 | 0.829 |
| 0.392 | −0.702 | 0.800 | −0.799 | 0.554 | 0.829 | 0.293 | −0.530 | 0.829 |
| 0.396 | 0.131 | 0.800 | −0.797 | 0.363 | 0.829 | 0.318 | 0.307 | 0.829 |
| 0.419 | 0.070 | 0.800 | −0.771 | 0.613 | 0.829 | 0.326 | −0.586 | 0.829 |
| 0.424 | −0.759 | 0.800 | −0.762 | 0.309 | 0.829 | 0.343 | 0.247 | 0.829 |
| 0.441 | 0.008 | 0.800 | −0.734 | 0.667 | 0.829 | 0.358 | −0.643 | 0.829 |
| 0.455 | −0.817 | 0.800 | −0.708 | 0.274 | 0.829 | 0.368 | 0.187 | 0.829 |
| 0.463 | −0.054 | 0.800 | −0.692 | 0.716 | 0.829 | 0.390 | −0.700 | 0.829 |
| 0.484 | −0.116 | 0.800 | −0.644 | 0.761 | 0.829 | 0.391 | 0.126 | 0.829 |
| 0.487 | −0.874 | 0.800 | −0.643 | 0.268 | 0.829 | 0.413 | 0.064 | 0.829 |
| 0.504 | −0.179 | 0.800 | −0.593 | 0.801 | 0.829 | 0.421 | −0.757 | 0.829 |
| 0.518 | −0.932 | 0.800 | −0.578 | 0.271 | 0.829 | 0.435 | 0.003 | 0.829 |
| 0.524 | −0.241 | 0.800 | −0.538 | 0.836 | 0.829 | 0.452 | −0.815 | 0.829 |
| 0.457 | −0.059 | 0.829 | −0.684 | 0.727 | 0.857 | 0.387 | 0.118 | 0.857 |
| 0.477 | −0.121 | 0.829 | −0.636 | 0.771 | 0.857 | 0.387 | −0.700 | 0.857 |
| 0.482 | −0.872 | 0.829 | −0.619 | 0.300 | 0.857 | 0.409 | 0.058 | 0.857 |
| 0.497 | −0.183 | 0.829 | −0.585 | 0.810 | 0.857 | 0.418 | −0.757 | 0.857 |
| 0.513 | −0.930 | 0.829 | −0.555 | 0.300 | 0.857 | 0.430 | −0.004 | 0.857 |
| 0.517 | −0.245 | 0.829 | −0.529 | 0.844 | 0.857 | 0.448 | −0.814 | 0.857 |
| 0.536 | −0.307 | 0.829 | −0.490 | 0.293 | 0.857 | 0.451 | −0.065 | 0.857 |
| 0.543 | −0.988 | 0.829 | −0.471 | 0.872 | 0.857 | 0.471 | −0.127 | 0.857 |
| 0.555 | −0.370 | 0.829 | −0.427 | 0.278 | 0.857 | 0.479 | −0.871 | 0.857 |
| 0.573 | −1.046 | 0.829 | −0.410 | 0.894 | 0.857 | 0.491 | −0.188 | 0.857 |
| 0.574 | −0.432 | 0.829 | −0.367 | 0.254 | 0.857 | 0.509 | −0.929 | 0.857 |
| 0.592 | −0.495 | 0.829 | −0.347 | 0.907 | 0.857 | 0.511 | −0.250 | 0.857 |
| 0.602 | −1.104 | 0.829 | −0.310 | 0.223 | 0.857 | 0.530 | −0.312 | 0.857 |
| 0.610 | −0.558 | 0.829 | −0.282 | 0.912 | 0.857 | 0.538 | −0.987 | 0.857 |
| 0.628 | −0.621 | 0.829 | −0.257 | 0.186 | 0.857 | 0.548 | −0.374 | 0.857 |
| 0.631 | −1.163 | 0.829 | −0.217 | 0.907 | 0.857 | 0.567 | −0.436 | 0.857 |
| 0.645 | −0.684 | 0.829 | −0.206 | 0.145 | 0.857 | 0.567 | −1.044 | 0.857 |
| 0.658 | −1.222 | 0.829 | −0.159 | 0.101 | 0.857 | 0.585 | −0.499 | 0.857 |

TABLE I-continued

| X | Y | Z' | X | Y | Z' | X | Y | Z' |
|---|---|---|---|---|---|---|---|---|
| 0.662 | −0.747 | 0.829 | −0.154 | 0.892 | 0.857 | 0.596 | −1.103 | 0.857 |
| 0.679 | −0.810 | 0.829 | −0.114 | 0.054 | 0.857 | 0.603 | −0.561 | 0.857 |
| 0.685 | −1.281 | 0.829 | −0.095 | 0.867 | 0.857 | 0.620 | −0.623 | 0.857 |
| 0.696 | −0.873 | 0.829 | −0.071 | 0.006 | 0.857 | 0.624 | −1.161 | 0.857 |
| 0.712 | −1.341 | 0.829 | −0.040 | 0.833 | 0.857 | 0.637 | −0.686 | 0.857 |
| 0.713 | −0.936 | 0.829 | −0.030 | −0.044 | 0.857 | 0.651 | −1.220 | 0.857 |
| 0.729 | −0.999 | 0.829 | 0.010 | −0.095 | 0.857 | 0.654 | −0.748 | 0.857 |
| 0.738 | −1.401 | 0.829 | 0.011 | 0.792 | 0.857 | 0.671 | −0.811 | 0.857 |
| 0.746 | −1.062 | 0.829 | 0.048 | −0.148 | 0.857 | 0.677 | −1.279 | 0.857 |
| 0.762 | −1.125 | 0.829 | 0.056 | 0.746 | 0.857 | 0.688 | −0.874 | 0.857 |
| 0.765 | −1.460 | 0.829 | 0.086 | −0.201 | 0.857 | 0.703 | −1.339 | 0.857 |
| 0.778 | −1.188 | 0.829 | 0.098 | 0.696 | 0.857 | 0.704 | −0.936 | 0.857 |
| 0.794 | −1.519 | 0.829 | 0.122 | −0.254 | 0.857 | 0.721 | −0.999 | 0.857 |
| 0.795 | −1.251 | 0.829 | 0.136 | 0.644 | 0.857 | 0.730 | −1.398 | 0.857 |
| 0.811 | −1.315 | 0.829 | 0.158 | −0.308 | 0.857 | 0.737 | −1.062 | 0.857 |
| 0.824 | −1.577 | 0.829 | 0.171 | 0.589 | 0.857 | 0.753 | −1.125 | 0.857 |
| 0.824 | −1.577 | 0.829 | 0.193 | −0.363 | 0.857 | 0.756 | −1.457 | 0.857 |
| 0.827 | −1.378 | 0.829 | 0.203 | 0.533 | 0.857 | 0.770 | −1.187 | 0.857 |
| 0.842 | −1.441 | 0.829 | 0.227 | −0.418 | 0.857 | 0.785 | −1.515 | 0.857 |
| 0.858 | −1.505 | 0.829 | 0.234 | 0.476 | 0.857 | 0.786 | −1.250 | 0.857 |
| 0.872 | −1.568 | 0.829 | 0.260 | −0.474 | 0.857 | 0.802 | −1.313 | 0.857 |
| −0.806 | 0.504 | 0.857 | 0.262 | 0.418 | 0.857 | 0.814 | −1.573 | 0.857 |
| −0.804 | 0.439 | 0.857 | 0.289 | 0.359 | 0.857 | 0.814 | −1.573 | 0.857 |
| −0.791 | 0.566 | 0.857 | 0.293 | −0.530 | 0.857 | 0.818 | −1.376 | 0.857 |
| −0.783 | 0.378 | 0.857 | 0.315 | 0.299 | 0.857 | 0.833 | −1.439 | 0.857 |
| −0.763 | 0.625 | 0.857 | 0.325 | −0.586 | 0.857 | 0.849 | −1.502 | 0.857 |
| −0.743 | 0.327 | 0.857 | 0.340 | 0.239 | 0.857 | 0.863 | −1.565 | 0.857 |
| −0.727 | 0.679 | 0.857 | 0.356 | −0.643 | 0.857 | −0.796 | 0.518 | 0.886 |
| −0.684 | 0.303 | 0.857 | 0.364 | 0.179 | 0.857 | −0.792 | 0.454 | 0.886 |
| −0.782 | 0.581 | 0.886 | 0.292 | −0.531 | 0.886 | 0.809 | −1.374 | 0.886 |
| −0.769 | 0.394 | 0.886 | 0.313 | 0.291 | 0.886 | 0.825 | −1.436 | 0.886 |
| −0.755 | 0.639 | 0.886 | 0.323 | −0.587 | 0.886 | 0.840 | −1.499 | 0.886 |
| −0.723 | 0.350 | 0.886 | 0.337 | 0.232 | 0.886 | 0.854 | −1.561 | 0.886 |
| −0.719 | 0.692 | 0.886 | 0.354 | −0.643 | 0.886 | −0.788 | 0.534 | 0.914 |
| −0.675 | 0.740 | 0.886 | 0.360 | 0.172 | 0.886 | −0.782 | 0.470 | 0.914 |
| −0.661 | 0.334 | 0.886 | 0.383 | 0.111 | 0.886 | −0.775 | 0.596 | 0.914 |
| −0.627 | 0.782 | 0.886 | 0.385 | −0.700 | 0.886 | −0.754 | 0.413 | 0.914 |
| −0.597 | 0.330 | 0.886 | 0.404 | 0.051 | 0.886 | −0.747 | 0.654 | 0.914 |
| −0.575 | 0.820 | 0.886 | 0.415 | −0.757 | 0.886 | −0.711 | 0.706 | 0.914 |
| −0.533 | 0.324 | 0.886 | 0.425 | −0.010 | 0.886 | −0.702 | 0.377 | 0.914 |
| −0.519 | 0.852 | 0.886 | 0.445 | −0.814 | 0.886 | −0.667 | 0.753 | 0.914 |
| −0.469 | 0.312 | 0.886 | 0.446 | −0.071 | 0.886 | −0.640 | 0.365 | 0.914 |
| −0.460 | 0.878 | 0.886 | 0.466 | −0.132 | 0.886 | −0.618 | 0.794 | 0.914 |
| −0.409 | 0.291 | 0.886 | 0.475 | −0.871 | 0.886 | −0.576 | 0.357 | 0.914 |
| −0.399 | 0.898 | 0.886 | 0.486 | −0.194 | 0.886 | −0.565 | 0.831 | 0.914 |
| −0.351 | 0.262 | 0.886 | 0.504 | −0.928 | 0.886 | −0.513 | 0.345 | 0.914 |
| −0.336 | 0.910 | 0.886 | 0.505 | −0.255 | 0.886 | −0.509 | 0.861 | 0.914 |
| −0.297 | 0.228 | 0.886 | 0.524 | −0.317 | 0.886 | −0.452 | 0.326 | 0.914 |
| −0.272 | 0.913 | 0.886 | 0.533 | −0.986 | 0.886 | −0.450 | 0.886 | 0.914 |
| −0.245 | 0.188 | 0.886 | 0.542 | −0.379 | 0.886 | −0.394 | 0.300 | 0.914 |
| −0.208 | 0.906 | 0.886 | 0.560 | −0.440 | 0.886 | −0.389 | 0.904 | 0.914 |
| −0.197 | 0.146 | 0.886 | 0.562 | −1.043 | 0.886 | −0.339 | 0.268 | 0.914 |
| −0.151 | 0.101 | 0.886 | 0.578 | −0.502 | 0.886 | −0.326 | 0.914 | 0.914 |
| −0.146 | 0.889 | 0.886 | 0.590 | −1.101 | 0.886 | −0.287 | 0.230 | 0.914 |
| −0.108 | 0.053 | 0.886 | 0.596 | −0.564 | 0.886 | −0.262 | 0.915 | 0.914 |
| −0.087 | 0.862 | 0.886 | 0.613 | −0.626 | 0.886 | −0.237 | 0.189 | 0.914 |
| −0.066 | 0.004 | 0.886 | 0.618 | −1.159 | 0.886 | −0.198 | 0.906 | 0.914 |
| −0.033 | 0.827 | 0.886 | 0.630 | −0.688 | 0.886 | −0.191 | 0.146 | 0.914 |
| −0.025 | −0.046 | 0.886 | 0.644 | −1.218 | 0.886 | −0.146 | 0.100 | 0.914 |
| 0.014 | −0.097 | 0.886 | 0.647 | −0.750 | 0.886 | −0.137 | 0.886 | 0.914 |
| 0.016 | 0.785 | 0.886 | 0.664 | −0.813 | 0.886 | −0.104 | 0.052 | 0.914 |
| 0.051 | −0.149 | 0.886 | 0.670 | −1.277 | 0.886 | −0.080 | 0.858 | 0.914 |
| 0.060 | 0.738 | 0.886 | 0.680 | −0.875 | 0.886 | −0.063 | 0.003 | 0.914 |
| 0.088 | −0.202 | 0.886 | 0.696 | −1.336 | 0.886 | −0.027 | 0.822 | 0.914 |
| 0.101 | 0.688 | 0.886 | 0.697 | −0.937 | 0.886 | −0.023 | −0.048 | 0.914 |
| 0.124 | −0.256 | 0.886 | 0.713 | −0.999 | 0.886 | 0.015 | −0.099 | 0.914 |
| 0.137 | 0.635 | 0.886 | 0.721 | −1.395 | 0.886 | 0.020 | 0.779 | 0.914 |
| 0.159 | −0.310 | 0.886 | 0.729 | −1.062 | 0.886 | 0.053 | −0.151 | 0.914 |
| 0.171 | 0.581 | 0.886 | 0.745 | −1.124 | 0.886 | 0.064 | 0.732 | 0.914 |
| 0.193 | −0.364 | 0.886 | 0.748 | −1.454 | 0.886 | 0.089 | −0.204 | 0.914 |
| 0.203 | 0.525 | 0.886 | 0.761 | −1.187 | 0.886 | 0.103 | 0.681 | 0.914 |
| 0.227 | −0.419 | 0.886 | 0.776 | −1.512 | 0.886 | 0.124 | −0.257 | 0.914 |
| 0.233 | 0.467 | 0.886 | 0.777 | −1.249 | 0.886 | 0.139 | 0.628 | 0.914 |
| 0.259 | −0.475 | 0.886 | 0.793 | −1.311 | 0.886 | 0.159 | −0.311 | 0.914 |
| 0.261 | 0.409 | 0.886 | 0.805 | −1.569 | 0.886 | 0.172 | 0.574 | 0.914 |
| 0.287 | 0.351 | 0.886 | 0.805 | −1.569 | 0.886 | 0.192 | −0.366 | 0.914 |
| 0.203 | 0.517 | 0.914 | 0.753 | −1.185 | 0.914 | 0.104 | 0.677 | 0.943 |

TABLE I-continued

| X | Y | Z' | X | Y | Z' | X | Y | Z' |
|---|---|---|---|---|---|---|---|---|
| 0.225 | −0.421 | 0.914 | 0.768 | −1.508 | 0.914 | 0.123 | −0.258 | 0.943 |
| 0.232 | 0.460 | 0.914 | 0.769 | −1.247 | 0.914 | 0.139 | 0.624 | 0.943 |
| 0.258 | −0.476 | 0.914 | 0.785 | −1.309 | 0.914 | 0.157 | −0.312 | 0.943 |
| 0.259 | 0.402 | 0.914 | 0.797 | −1.565 | 0.914 | 0.171 | 0.569 | 0.943 |
| 0.285 | 0.344 | 0.914 | 0.797 | −1.565 | 0.914 | 0.191 | −0.366 | 0.943 |
| 0.289 | −0.531 | 0.914 | 0.801 | −1.371 | 0.914 | 0.201 | 0.513 | 0.943 |
| 0.310 | 0.285 | 0.914 | 0.816 | −1.434 | 0.914 | 0.223 | −0.421 | 0.943 |
| 0.321 | −0.587 | 0.914 | 0.832 | −1.496 | 0.914 | 0.230 | 0.455 | 0.943 |
| 0.333 | 0.225 | 0.914 | 0.845 | −1.558 | 0.914 | 0.255 | −0.476 | 0.943 |
| 0.351 | −0.643 | 0.914 | −0.782 | 0.551 | 0.943 | 0.256 | 0.398 | 0.943 |
| 0.356 | 0.166 | 0.914 | −0.776 | 0.488 | 0.943 | 0.282 | 0.339 | 0.943 |
| 0.378 | 0.105 | 0.914 | −0.770 | 0.613 | 0.943 | 0.287 | −0.531 | 0.943 |
| 0.382 | −0.700 | 0.914 | −0.742 | 0.670 | 0.943 | 0.306 | 0.280 | 0.943 |
| 0.400 | 0.045 | 0.914 | −0.740 | 0.435 | 0.943 | 0.318 | −0.587 | 0.943 |
| 0.412 | −0.756 | 0.914 | −0.704 | 0.721 | 0.943 | 0.329 | 0.221 | 0.943 |
| 0.421 | −0.016 | 0.914 | 0.684 | 0.406 | 0.943 | 0.348 | −0.643 | 0.943 |
| 0.441 | −0.076 | 0.914 | −0.660 | 0.767 | 0.943 | 0.352 | 0.161 | 0.943 |
| 0.441 | −0.813 | 0.914 | −0.621 | 0.394 | 0.943 | 0.374 | 0.101 | 0.943 |
| 0.460 | −0.137 | 0.914 | −0.611 | 0.807 | 0.943 | 0.378 | −0.699 | 0.943 |
| 0.471 | −0.870 | 0.914 | −0.559 | 0.381 | 0.943 | 0.395 | 0.041 | 0.943 |
| 0.480 | −0.198 | 0.914 | −0.557 | 0.842 | 0.943 | 0.408 | −0.755 | 0.943 |
| 0.499 | −0.259 | 0.914 | −0.501 | 0.872 | 0.943 | 0.415 | −0.019 | 0.943 |
| 0.500 | −0.927 | 0.914 | −0.498 | 0.363 | 0.943 | 0.435 | −0.080 | 0.943 |
| 0.517 | −0.321 | 0.914 | −0.442 | 0.895 | 0.943 | 0.437 | −0.812 | 0.943 |
| 0.528 | −0.984 | 0.914 | −0.439 | 0.338 | 0.943 | 0.455 | −0.140 | 0.943 |
| 0.536 | −0.382 | 0.914 | −0.383 | 0.307 | 0.943 | 0.466 | −0.869 | 0.943 |
| 0.554 | −0.443 | 0.914 | −0.380 | 0.911 | 0.943 | 0.474 | −0.201 | 0.943 |
| 0.557 | −1.042 | 0.914 | −0.330 | 0.272 | 0.943 | 0.493 | −0.262 | 0.943 |
| 0.571 | −0.505 | 0.914 | −0.317 | 0.920 | 0.943 | 0.495 | −0.925 | 0.943 |
| 0.585 | −1.099 | 0.914 | −0.280 | 0.233 | 0.943 | 0.511 | −0.323 | 0.943 |
| 0.589 | −0.567 | 0.914 | −0.253 | 0.919 | 0.943 | 0.523 | −0.982 | 0.943 |
| 0.606 | −0.628 | 0.914 | −0.233 | 0.191 | 0.943 | 0.529 | −0.384 | 0.943 |
| 0.612 | −1.157 | 0.914 | −0.191 | 0.908 | 0.943 | 0.547 | −0.445 | 0.943 |
| 0.623 | −0.690 | 0.914 | −0.187 | 0.146 | 0.943 | 0.551 | −1.040 | 0.943 |
| 0.638 | −1.216 | 0.914 | −0.144 | 0.099 | 0.943 | 0.564 | −0.506 | 0.943 |
| 0.640 | −0.752 | 0.914 | −0.131 | 0.886 | 0.943 | 0.579 | −1.097 | 0.943 |
| 0.656 | −0.814 | 0.914 | −0.102 | 0.051 | 0.943 | 0.582 | −0.568 | 0.943 |
| 0.663 | −1.275 | 0.914 | −0.075 | 0.856 | 0.943 | 0.599 | −0.629 | 0.943 |
| 0.673 | −0.876 | 0.914 | −0.062 | 0.002 | 0.943 | 0.605 | −1.155 | 0.943 |
| 0.688 | −1.334 | 0.914 | −0.023 | 0.819 | 0.943 | 0.616 | −0.691 | 0.943 |
| 0.689 | −0.937 | 0.914 | −0.023 | −0.049 | 0.943 | 0.631 | −1.213 | 0.943 |
| 0.705 | −0.999 | 0.914 | 0.015 | −0.100 | 0.943 | 0.632 | −0.752 | 0.943 |
| 0.714 | −1.392 | 0.914 | 0.024 | 0.775 | 0.943 | 0.649 | −0.814 | 0.943 |
| 0.721 | −1.061 | 0.914 | 0.052 | −0.152 | 0.943 | 0.656 | −1.272 | 0.943 |
| 0.737 | −1.123 | 0.914 | 0.066 | 0.728 | 0.943 | 0.665 | −0.875 | 0.943 |
| 0.740 | −1.451 | 0.914 | 0.088 | −0.204 | 0.943 | 0.681 | −1.331 | 0.943 |
| 0.681 | −0.937 | 0.943 | −0.021 | 0.819 | 0.971 | 0.624 | −1.210 | 0.971 |
| 0.698 | −0.998 | 0.943 | 0.014 | −0.099 | 0.971 | 0.625 | −0.751 | 0.971 |
| 0.706 | −1.389 | 0.943 | 0.025 | 0.775 | 0.971 | 0.641 | −0.812 | 0.971 |
| 0.714 | −1.060 | 0.943 | 0.050 | −0.151 | 0.971 | 0.649 | −1.268 | 0.971 |
| 0.730 | −1.122 | 0.943 | 0.066 | 0.726 | 0.971 | 0.657 | −0.874 | 0.971 |
| 0.732 | −1.447 | 0.943 | 0.086 | −0.203 | 0.971 | 0.673 | −1.327 | 0.971 |
| 0.745 | −1.183 | 0.943 | 0.103 | 0.675 | 0.971 | 0.674 | −0.935 | 0.971 |
| 0.759 | −1.505 | 0.943 | 0.121 | −0.256 | 0.971 | 0.690 | −0.996 | 0.971 |
| 0.761 | −1.245 | 0.943 | 0.137 | 0.621 | 0.971 | 0.698 | −1.385 | 0.971 |
| 0.777 | −1.307 | 0.943 | 0.155 | −0.310 | 0.971 | 0.706 | −1.058 | 0.971 |
| 0.789 | −1.561 | 0.943 | 0.169 | 0.567 | 0.971 | 0.722 | −1.119 | 0.971 |
| 0.789 | −1.561 | 0.943 | 0.188 | −0.364 | 0.971 | 0.724 | −1.443 | 0.971 |
| 0.793 | −1.369 | 0.943 | 0.199 | 0.510 | 0.971 | 0.737 | −1.181 | 0.971 |
| 0.808 | −1.430 | 0.943 | 0.220 | −0.419 | 0.971 | 0.751 | −1.501 | 0.971 |
| 0.823 | −1.492 | 0.943 | 0.226 | 0.453 | 0.971 | 0.753 | −1.242 | 0.971 |
| 0.837 | −1.554 | 0.943 | 0.252 | −0.474 | 0.971 | 0.769 | −1.304 | 0.971 |
| −0.780 | 0.569 | 0.971 | 0.253 | 0.395 | 0.971 | 0.780 | −1.557 | 0.971 |
| −0.768 | 0.631 | 0.971 | 0.278 | 0.337 | 0.971 | 0.780 | −1.557 | 0.971 |
| −0.767 | 0.507 | 0.971 | 0.283 | 0.529 | 0.971 | 0.785 | −1.365 | 0.971 |
| −0.740 | 0.688 | 0.971 | 0.301 | 0.278 | 0.971 | 0.800 | −1.427 | 0.971 |
| −0.726 | 0.460 | 0.971 | 0.314 | 0.585 | 0.971 | 0.815 | −1.488 | 0.971 |
| −0.701 | 0.738 | 0.971 | 0.325 | 0.219 | 0.971 | 0.828 | −1.550 | 0.971 |
| −0.668 | 0.436 | 0.971 | 0.344 | −0.640 | 0.971 | −0.780 | 0.589 | 1.000 |
| −0.656 | 0.783 | 0.971 | 0.347 | 0.160 | 0.971 | −0.770 | 0.651 | 1.000 |
| −0.607 | 0.420 | 0.971 | 0.368 | 0.100 | 0.971 | −0.762 | 0.529 | 1.000 |
| −0.606 | 0.821 | 0.971 | 0.374 | −0.696 | 0.971 | −0.741 | 0.707 | 1.000 |
| −0.552 | 0.855 | 0.971 | 0.389 | 0.040 | 0.971 | −0.715 | 0.487 | 1.000 |
| −0.546 | 0.402 | 0.971 | 0.403 | −0.753 | 0.971 | −0.701 | 0.756 | 1.000 |
| −0.495 | 0.883 | 0.971 | 0.409 | −0.020 | 0.971 | −0.656 | 0.464 | 1.000 |
| −0.487 | 0.378 | 0.971 | 0.429 | −0.081 | 0.971 | −0.655 | 0.799 | 1.000 |
| −0.436 | 0.905 | 0.971 | 0.432 | −0.809 | 0.971 | −0.604 | 0.837 | 1.000 |

TABLE I-continued

| X | Y | Z' | X | Y | Z' | X | Y | Z' |
|---|---|---|---|---|---|---|---|---|
| −0.431 | 0.348 | 0.971 | 0.448 | −0.141 | 0.971 | −0.596 | 0.443 | 1.000 |
| −0.377 | 0.314 | 0.971 | 0.461 | −0.866 | 0.971 | −0.549 | 0.869 | 1.000 |
| −0.374 | 0.920 | 0.971 | 0.467 | −0.202 | 0.971 | −0.537 | 0.419 | 1.000 |
| −0.326 | 0.277 | 0.971 | 0.486 | −0.262 | 0.971 | −0.492 | 0.896 | 1.000 |
| −0.311 | 0.927 | 0.971 | 0.490 | −0.922 | 0.971 | −0.481 | 0.391 | 1.000 |
| −0.277 | 0.236 | 0.971 | 0.504 | −0.323 | 0.971 | −0.432 | 0.917 | 1.000 |
| −0.248 | 0.925 | 0.971 | 0.518 | −0.979 | 0.971 | −0.427 | 0.358 | 1.000 |
| −0.231 | 0.193 | 0.971 | 0.522 | −0.384 | 0.971 | −0.375 | 0.322 | 1.000 |
| −0.186 | 0.147 | 0.971 | 0.540 | −0.445 | 0.971 | −0.370 | 0.931 | 1.000 |
| −0.185 | 0.912 | 0.971 | 0.545 | −1.037 | 0.971 | −0.325 | 0.282 | 1.000 |
| −0.144 | 0.100 | 0.971 | 0.557 | −0.506 | 0.971 | −0.307 | 0.936 | 1.000 |
| −0.126 | 0.889 | 0.971 | 0.573 | −1.094 | 0.971 | −0.278 | 0.240 | 1.000 |
| −0.102 | 0.052 | 0.971 | 0.574 | −0.567 | 0.971 | −0.244 | 0.933 | 1.000 |
| −0.071 | 0.857 | 0.971 | 0.591 | −0.628 | 0.971 | −0.232 | 0.196 | 1.000 |
| −0.063 | 0.003 | 0.971 | 0.599 | −1.152 | 0.971 | −0.188 | 0.151 | 1.000 |
| −0.024 | −0.048 | 0.971 | 0.608 | −0.690 | 0.971 | −0.182 | 0.919 | 1.000 |
| −0.146 | 0.104 | 1.000 | 0.550 | −0.504 | 1.000 | | | |
| −0.124 | 0.895 | 1.000 | 0.566 | −1.090 | 1.000 | | | |
| −0.105 | 0.055 | 1.000 | 0.567 | −0.565 | 1.000 | | | |
| −0.070 | 0.862 | 1.000 | 0.584 | −0.626 | 1.000 | | | |
| −0.066 | 0.006 | 1.000 | 0.592 | −1.147 | 1.000 | | | |
| −0.027 | −0.045 | 1.000 | 0.600 | −0.687 | 1.000 | | | |
| −0.021 | 0.822 | 1.000 | 0.617 | −0.748 | 1.000 | | | |
| 0.010 | −0.096 | 1.000 | 0.617 | −1.206 | 1.000 | | | |
| 0.024 | 0.777 | 1.000 | 0.633 | −0.810 | 1.000 | | | |
| 0.047 | −0.148 | 1.000 | 0.642 | −1.264 | 1.000 | | | |
| 0.064 | 0.728 | 1.000 | 0.650 | −0.871 | 1.000 | | | |
| 0.082 | −0.200 | 1.000 | 0.666 | −1.323 | 1.000 | | | |
| 0.100 | 0.676 | 1.000 | 0.666 | −0.932 | 1.000 | | | |
| 0.117 | −0.253 | 1.000 | 0.682 | −0.993 | 1.000 | | | |
| 0.134 | 0.623 | 1.000 | 0.690 | −1.381 | 1.000 | | | |
| 0.151 | −0.307 | 1.000 | 0.698 | 1.055 | 1.000 | | | |
| 0.165 | 0.568 | 1.000 | 0.714 | −1.116 | 1.000 | | | |
| 0.184 | −0.361 | 1.000 | 0.716 | −1.439 | 1.000 | | | |
| 0.195 | 0.511 | 1.000 | 0.729 | −1.177 | 1.000 | | | |
| 0.216 | −0.415 | 1.000 | 0.743 | −1.496 | 1.000 | | | |
| 0.222 | 0.454 | 1.000 | 0.745 | −1.239 | 1.000 | | | |
| 0.248 | 0.396 | 1.000 | 0.761 | −1.300 | 1.000 | | | |
| 0.248 | 0.470 | 1.000 | 0.772 | −1.553 | 1.000 | | | |
| 0.272 | 0.338 | 1.000 | 0.772 | −1.553 | 1.000 | | | |
| 0.279 | −0.525 | 1.000 | 0.776 | −1.361 | 1.000 | | | |
| 0.296 | 0.279 | 1.000 | 0.792 | −1.423 | 1.000 | | | |
| 0.310 | 0.581 | 1.000 | 0.807 | −1.484 | 1.000 | | | |
| 0.319 | 0.220 | 1.000 | 0.820 | −1.546 | 1.000 | | | |
| 0.340 | −0.636 | 1.000 | | | | | | |
| 0.341 | 0.161 | 1.000 | | | | | | |
| 0.362 | 0.101 | 1.000 | | | | | | |
| 0.369 | −0.692 | 1.000 | | | | | | |
| 0.383 | 0.041 | 1.000 | | | | | | |
| 0.399 | −0.749 | 1.000 | | | | | | |
| 0.403 | −0.019 | 1.000 | | | | | | |
| 0.422 | −0.079 | 1.000 | | | | | | |
| 0.427 | −0.805 | 1.000 | | | | | | |
| 0.441 | 0.140 | 1.000 | | | | | | |
| 0.456 | 0.862 | 1.000 | | | | | | |
| 0.460 | −0.200 | 1.000 | | | | | | |
| 0.479 | −0.261 | 1.000 | | | | | | |
| 0.484 | −0.918 | 1.000 | | | | | | |
| 0.497 | −0.322 | 1.000 | | | | | | |
| 0.512 | −0.975 | 1.000 | | | | | | |
| 0.515 | −0.382 | 1.000 | | | | | | |
| 0.532 | −0.443 | 1.000 | | | | | | |
| 0.539 | −1.032 | 1.000 | | | | | | |

It will also be appreciated that the airfoil disclosed in the above Table may be scaled up or down geometrically for use in other similar turbine designs. Consequently, the coordinate values set forth in Table 1 may be scaled upwardly or downwardly such that the airfoil profile shape remains unchanged. A scaled version of the coordinates in Table 1 would be represented by X, Y and Z coordinate values of Table 1, with the non-dimensional Z coordinate value converted to inches, multiplied or divided by a constant number.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket including a bucket airfoil having an airfoil shape, said airfoil having a nominal profile substantially in accordance with Cartesian coordinate values of X, Y and Z set forth in Table I wherein the Z values are non-dimensional values from 0 to 1 convertible to Z distances in inches by multiplying the Z values by a height of the airfoil in inches, and wherein X and Y are distances in inches which, when connected by smooth continuing arcs, define airfoil profile sections at each distance Z, the profile sections at the Z distances being joined smoothly with one another to form a complete airfoil shape.

2. A turbine bucket according to claim 1 forming part of a first stage of a turbine.

3. A turbine bucket according to claim 1 wherein said airfoil shape lies in an envelope within ±0.040 inches in a direction normal to any airfoil surface location.

4. A turbine bucket according to claim 1 wherein the height of the turbine bucket from root to tip is 3.080 inches.

5. A turbine bucket including a bucket airfoil having an uncoated nominal airfoil profile substantially in accordance with Cartesian coordinate values of X, Y and Z set forth in Table I wherein the Z values are non-dimensional values from 0 to 1 convertible to Z distances in inches by multiplying the Z values by a height of the airfoil in inches, and wherein X and Y are distances in inches which, when connected by smooth continuing arcs, define airfoil profile sections at each Z distance, the profile sections at the Z distances being joined smoothly with one another to form a complete airfoil shape, the X, Y and Z distances being scalable as a function of the same constant or number to provide a scaled-up or scaled-down airfoil.

6. A turbine bucket according to claim 5 forming part of a first stage of a turbine.

7. A turbine bucket according to claim 5 wherein said airfoil shape lies in an envelope within ±0.040 inches in a direction normal to any airfoil surface location.

8. A turbine bucket according to claim 5 wherein the height of the turbine bucket from root to tip is 3.080 inches.

9. A turbine comprising a turbine wheel having a plurality of buckets, each of said buckets including an airfoil having an airfoil shape, said airfoil having a nominal profile substantially in accordance with Cartesian coordinate values of X, Y and Z set forth in Table I wherein the Z values are non-dimensional values from 0 to 1 convertible to Z distances in inches by multiplying the Z values by a height of the airfoil in inches, and wherein X and Y are distances in inches which, when connected by smooth continuing arcs, define the airfoil profile sections at each distance Z, the profile sections at the Z distances being joined smoothly with one another to form a complete airfoil shape.

10. A turbine according to claim 9 wherein the turbine wheel comprises a first stage of the turbine.

11. A turbine according to claim 9 wherein the turbine wheel has 60 buckets and X represents a distance parallel to the turbine axis of rotation.

12. A turbine according to claim 9 wherein the height of the turbine bucket from root to tip is 3.080 inches.

13. A turbine according to claim 9 wherein the Z height between an axial centerline of said turbine wheel and a root of each bucket is 22.180 inches and which corresponds to the non-dimensionalized Z at 0.000.

14. A turbine according to claim 13 wherein the height of the turbine bucket from root to tip is 3.080 inches.

15. A turbine comprising a turbine wheel having a plurality of buckets, each of said buckets including an airfoil having an uncoated nominal airfoil profile substantially in accordance with Cartesian coordinate values of X, Y and Z set forth in Table I wherein the Z values are non-dimensional values from 0 to 1 convertible to Z distances in inches by multiplying the Z values by a height of the airfoil in inches, and wherein X and Y are distances in inches which, when connected by smooth continuing arcs, define airfoil profile sections at each distance Z, the profile sections at the Z distances being joined smoothly with one another to form a complete airfoil shape, the X, Y and Z distances being scalable as a function of the same constant or number to provide a scaled-up or scaled-down bucket airfoil.

16. A turbine according to claim 15 wherein the turbine wheel comprises a first stage of the turbine.

17. A turbine according to claim 15 wherein the turbine wheel has 60 buckets and X represents a distance parallel to the turbine axis of rotation.

18. A turbine according to claim 15 wherein the height of the turbine bucket from root to tip is 3.080 inches.

19. A turbine according to claim 15 wherein the Z height between an axial centerline of said turbine wheel and a root of each bucket is 22.180 inches and which corresponds to the non-dimensionalized Z at 0.000.

20. A turbine according to claim 19 wherein the height of the turbine bucket from root to tip is 3.080 inches.

21. A turbine according to claim 15, said airfoil shape lying in an envelope within ±0.040 inches in a direction normal to any airfoil surface location.

* * * * *